US006231067B1

(12) United States Patent
Johnson et al.

(10) Patent No.: US 6,231,067 B1
(45) Date of Patent: May 15, 2001

(54) MOTORIZED STANDING WHEELCHAIR

(75) Inventors: Jay A. Johnson, Sauk Rapids; Paul T. Wade; Qinghuan Yu, both of St. Cloud, all of MN (US)

(73) Assignee: FENA Design, Inc., St. Cloud, MN (US)

( * ) Notice: Subject to any disclaimer, the term of this patent is extended or adjusted under 35 U.S.C. 154(b) by 0 days.

(21) Appl. No.: 09/005,810

(22) Filed: Jan. 12, 1998

(51) Int. Cl.[7] ..... A61G 5/14

(52) U.S. Cl. ..... 280/650; 180/65.1; 180/907

(58) Field of Search ..... 180/65.1, 65.5, 180/907; 280/250.1, 304.1, 47.4, 647, 650, 47.38; 297/DIG. 4, DIG. 10, 330

(56) References Cited

U.S. PATENT DOCUMENTS

| | | | | |
|---|---|---|---|---|
| 3,261,031 | | 7/1966 | Gates . | |
| 3,807,795 | | 4/1974 | Weant et al. | 297/330 |
| 3,952,822 | | 4/1976 | Udden et al. | 180/21 |
| 3,953,054 | | 4/1976 | Udden et al. . | |
| 3,964,786 | | 6/1976 | Mashuda | 297/330 |
| 4,076,304 | | 2/1978 | Deucher . | |
| 4,231,614 | | 11/1980 | Shaffer | 297/330 |
| 4,249,774 | * | 2/1981 | Andreasson | 297/DIG. 10 |
| 4,390,076 | * | 6/1983 | Wier et al. | 180/907 |
| 4,407,543 | | 10/1983 | Mashuda | 297/330 |

(List continued on next page.)

FOREIGN PATENT DOCUMENTS

| | | | | |
|---|---|---|---|---|
| 338689 | * | 10/1989 | (EP) | 180/907 |
| 2275029 | * | 8/1994 | (GB) | 180/65.1 |
| 90/08669 | * | 8/1990 | (WO) | 180/65.5 |

OTHER PUBLICATIONS

HiRider Owner's Manual; Retec USA, Inc.; A Gaymar Company; 06776–000; 7 pages, no date.
Chairman Manual; permobil; 2 pages; no date.
The Excelsior SR Brochure; American Medical Technologies, Inc.; 2 pages, no date.
Levo active–easy LAE Brochure; EVO AG Dottikon; 2 pages, no date.
Levo compact LC Brochure; Levo Ltd.; 2 pages, no date.
I.H.S. International Healthcare Solutions Inc Brochure; 3 pages, no date.
Levo dynamic LD Brochure; Levo AG; 2 pages, no date.
Levo mobil LCM Brochure; Levo Ltd.; 2 pages, no date.
Go–Bot Brochure; Innovative Products, Inc.; 2 pages, 1995.
Chief SR Brochure; Redman Wheelchairs; 2 pages, no date.

*Primary Examiner*—Frank Vanaman
(74) *Attorney, Agent, or Firm*—Merchant & Gould PC

(57) ABSTRACT

A standing wheelchair includes a base frame, a pair of front driveable wheels connected to the front end of the frame, and a pair of rear wheels connected to the rear end of the frame. A seat assembly is connected to the front end of the frame and includes a seat portion that is pivotable between a generally horizontal, seated position and a raised, angled standing position. The seat portion pivots about a central stub pivot shaft located at the front thereof, with the stub pivot shaft being vertically offset above the seat portion. An actuator is connected between the front end of the seat assembly and the rear end of the seat assembly to actuate the seat portion between the seated and standing positions. An adjustable knee support assembly is connected to the front end of the seat assembly and is located behind the axles of the front wheels, and a footrest plate is connected to the frame at the front end between the front pair of wheels. By offsetting the stub pivot shaft above the seat portion, the pivot axis of the seat portion is located between the user's knees, thereby reducing shear on the user. Further, the seat assembly is designed so as to be easily removable as a single unit from the base frame, to allow the use of different seat assemblies on the base frame.

29 Claims, 21 Drawing Sheets

U.S. PATENT DOCUMENTS

| | | | | |
|---|---|---|---|---|
| 4,456,086 | | 6/1984 | Wier et al. | 180/11 |
| 4,513,832 | | 4/1985 | Engman | 180/6.5 |
| 4,538,857 | | 9/1985 | Engmen . | |
| 4,545,616 | | 10/1985 | Booth . | |
| 4,552,404 | | 11/1985 | Congleton | 297/330 |
| 4,802,542 | | 2/1989 | Houston et al. | 180/65.5 |
| 4,809,804 | | 3/1989 | Houston et al. | 180/65.5 |
| 4,938,533 | | 7/1990 | Thielois | 297/337 |
| 4,957,302 | * | 9/1990 | Maxwell | 297/DIG. 4 |
| 5,024,486 | | 6/1991 | Auel | 297/330 |
| 5,096,008 | * | 3/1992 | Mankowski | 180/65.1 |
| 5,137,102 | | 8/1992 | Houston, Sr. et al. | 180/65.5 |
| 5,172,925 | | 12/1992 | Kendrick et al. | 280/250.1 |
| 5,211,414 | | 5/1993 | Galumbeck | 280/250.1 |
| 5,217,239 | | 6/1993 | Koet | 280/250.1 |
| 5,242,180 | | 9/1993 | Bergeron | 280/250.1 |
| 5,265,689 | | 11/1993 | Kauffmann | 180/65.5 |
| 5,308,028 | * | 5/1994 | Kornberg | 280/304.1 |
| 5,333,333 | | 8/1994 | Mah | 5/81.1 |
| 5,340,139 | | 8/1994 | Davis | 280/304.1 |
| 5,346,280 | * | 9/1994 | Deumite | 180/907 |
| 5,356,172 | | 10/1994 | Levy et al. | 280/650 |
| 5,363,934 | | 11/1994 | Edmund et al. | 180/6.5 |
| 5,366,036 | | 11/1994 | Perry | 180/65.1 |
| 5,375,913 | | 12/1994 | Blanchard | 297/330 |
| 5,401,044 | | 3/1995 | Galumbeck | 280/250.1 |
| 5,409,250 | | 4/1995 | Csotonyi | 280/304.1 |
| 5,458,349 | | 10/1995 | Mung-Tung | 280/250.1 |
| 5,484,151 | | 1/1996 | Tholkes | 280/250.1 |
| 5,490,687 | | 2/1996 | Scholl | 280/250.1 |
| 5,513,867 | | 5/1996 | Bloswick et al. | 280/250.1 |
| 5,520,403 | | 5/1996 | Bergstrom et al. | 280/250.1 |
| 5,520,439 | * | 5/1996 | Blount | 297/DIG. 10 |
| 5,551,105 | | 9/1996 | Short | 5/87.1 |
| 5,556,121 | | 9/1996 | Pillot | 280/304.1 |
| 5,592,997 | | 1/1997 | Ball | 180/65.1 |
| 5,593,211 | * | 1/1997 | Jay et al. | 297/DIG. 4 |
| 5,601,302 | | 2/1997 | Beard et al. | 280/250.1 |
| 5,609,348 | | 3/1997 | Galumbeck | 280/250.1 |
| 5,613,697 | | 3/1997 | Johnson | 280/250.1 |
| 5,664,266 | * | 9/1997 | Williams et al. | 297/DIG. 4 |
| 5,772,237 | * | 6/1998 | Finch et al. | 180/65.1 |

* cited by examiner

MOTORIZED STANDING WHEELCHAIR

FIELD OF THE INVENTION

The present invention relates to wheelchairs, and in particular to standing wheelchairs in which the wheelchair is able to automatically move a user between seated and standing positions.

BACKGROUND OF THE INVENTION

Standing wheelchairs, including both motorized and non-motorized versions having many different designs, are known in the art. These known standing wheelchairs are generally designed with the center of mass in the center of the wheelchair while the user is in the seated position. As the user is moved into the standing position, he or she is moved toward the front of the wheelchair, thus changing the location of the center of mass. To counterbalance the weight of the user at the front of the wheelchair when in the standing position, many wheelchairs are designed with a large amount of weight in the rear to prevent tipping of the wheelchair. Other standing wheelchairs are designed so that when the user is in the standing position, the footrest portions of the wheelchair contact the ground and in this manner prevent tipping of the wheelchair. However, when the user is moved into the standing position at the front of the chair, most of the user's weight is located at the front of the wheelchair, resulting in a "tippy" feeling in which the user feels that the wheelchair is about to tip over. To a person with a disability who must rely upon the wheelchair for mobility and support, and who utilizes the standing capabilities of the wheelchair to lead a more productive and independent life, this "tippy" feeling is an extremely uncomfortable sensation and detracts from the user's ability to fully lead a productive and independent life.

A common problem with all standing wheelchairs is the occurrence of shear which is created while the lifting mechanism is in motion. Shear is due to the offset of the user's knee joint and the pivot point of the seat assembly, with the greater the distance between these two points, the greater the shear and the resulting amount of discomfort, often times causing skin abrasions. Over time, the resulting skin abrasions can ultimately lead to the development of pressure sores, which are a significant problem for many people with disabilities. Therefore, a standing wheelchair should reduce the distance between the user's knee joint and the pivot point of the seat of the wheelchair as much as possible, in order to reduce the amount of shear that is created during movements between the seated and standing positions.

Existing standing wheelchairs also position a user at an angle of up to 27 degrees from a fully vertical standing position. This compromised posture prevents the user from reaching objects positioned at a greater distance, by reducing the distance of the user's reach, thus decreasing the user's independence. A proper standing posture is also important for the health and lasting comfort of the user.

Further, people often shy away from users of wheelchairs since wheelchairs are in general unapproachable, intimidating, ugly and awkward, utilizing intricate and complicated mechanical parts and systems which give the wheelchair a distracting appearance. Therefore, a standing wheelchair that is visually appealing, and which eliminates, or hides from view, many of the intricate mechanical components would be beneficial.

A standing wheelchair should also be adjustable so as to be able to accommodate different users who are each sized differently. Further, as with most machines, a standing wheelchair should be simple in design with the minimum number of parts, so as to reduce assembly time and reduce the number of parts that could potentially break down, need maintenance or repair.

Therefore there exists a need for a standing wheelchair that reduces shear on the user when moving between the seated and standing positions, as well as reduces stress on the lower body of the user, improves the reaching capabilities of the user while providing lasting comfort to the user in the standing position, adjusts so as to accommodate different users, and is simple in design with a reduced number of parts and systems. In addition to the above requirements, the standing wheelchair should be designed so as to be aesthetically appealing.

SUMMARY OF THE INVENTION

Therefore the general purpose of the present invention is to provide a motorized standing wheelchair that reduces the distance between the pivot axis of the seat assembly and the user's knee joints, thereby reducing shear on the user, improves the reaching capability of the user while providing lasting comfort to the user, is adjustable to accommodate different users, is simple in design with a reduced number of parts, and has enhanced visual appeal.

A preferred embodiment of the standing wheelchair in accordance with the principles of the present invention includes a base frame, a pair of front driveable wheels connected to the front end of the frame, and at least one rear wheel connected to the rear end of the frame. A seat assembly is connected to the center of the front end of the frame and includes a seat portion that is pivotable between a generally horizontal, seated position and a raised, angled standing position. An actuator is connected between the front end of the seat assembly and the rear end of the seat portion to actuate the seat portion between the seated and standing positions. The seat assembly includes a stub pivot shaft located proximate the front center of the seat portion and spaced above the seat portion, to permit the pivoting movements of the seat portion. By utilizing a single, centrally located stub pivot shaft, the number of parts is reduced, thus simplifying the wheelchair and reducing the number of parts that could potentially wear and need replacement, as well as enhancing the appearance of the wheelchair. Further, by spacing the stub pivot shaft above the seat portion, the distance between the pivot axis and the user's knee joints is reduced, thereby reducing shear on the user.

The seat assembly includes a seat pivot connected to the seat portion adjacent the front center thereof and having a first end that extends vertically above the seat portion. The seat assembly further includes a pivot assembly connected to the front end of the base frame at the center thereof, with the pivot assembly having a pivot column that extends vertically above the seat portion and which is pivotally connected to the end of the seat pivot by the stub pivot shaft. In this manner, the stub pivot shaft is vertically raised above the seat portion such that when a user is positioned on the wheelchair, the stub pivot shaft is located generally between the legs of the user as well being located closer to the axis of the user's knee joints. As stated previously, this reduces the distance between the pivot axis of the seat assembly and the user's knee joints, thereby reducing shear on the user.

The actuator for the seat assembly is pivotally connected at one of its ends to the front end of the seat assembly via the pivot assembly and fixed at its opposite end to the rear of the seat portion. The actuator extends generally centrally along the seat assembly, with no other mechanical linkage connected between the frame and the seat portion. Since no other linkage is present, the visual appeal of the wheelchair is enhanced, as well as reducing the number of mechanical parts and simplifying the structure of the wheelchair. In addition, the seat portion includes a channel shaped seat support bar extending parallel with the actuator. When the actuator extends to pivot the seat portion to the standing position, the actuator is substantially received within the channel of the seat support bar, effectively hiding the actuator from view and further increasing the visual appearance of the wheelchair.

The standing wheelchair of the present invention further includes a back support assembly connected to the seat portion that automatically adjusts itself from a slightly rearwardly angled orientation relative to the ground at the seated position of the seat portion, to a vertical orientation relative to the ground at the standing position. By adjusting in this manner, the back support assembly provides lasting comfort for the user of the wheelchair in both the seated and standing positions. The back support assembly further includes a mechanism for ensuring that a pair of arm rests connected thereto are maintained parallel to the ground as the seat portion pivots between the seated and standing positions.

In a further embodiment of the present invention, the wheelchair can be provided with a suspension system between the frame and the front wheels to improve the ride quality of the wheelchair.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a further embodiment of the invention.

DETAILED DESCRIPTION OF THE PREFERRED EMBODIMENT

Figure 1:
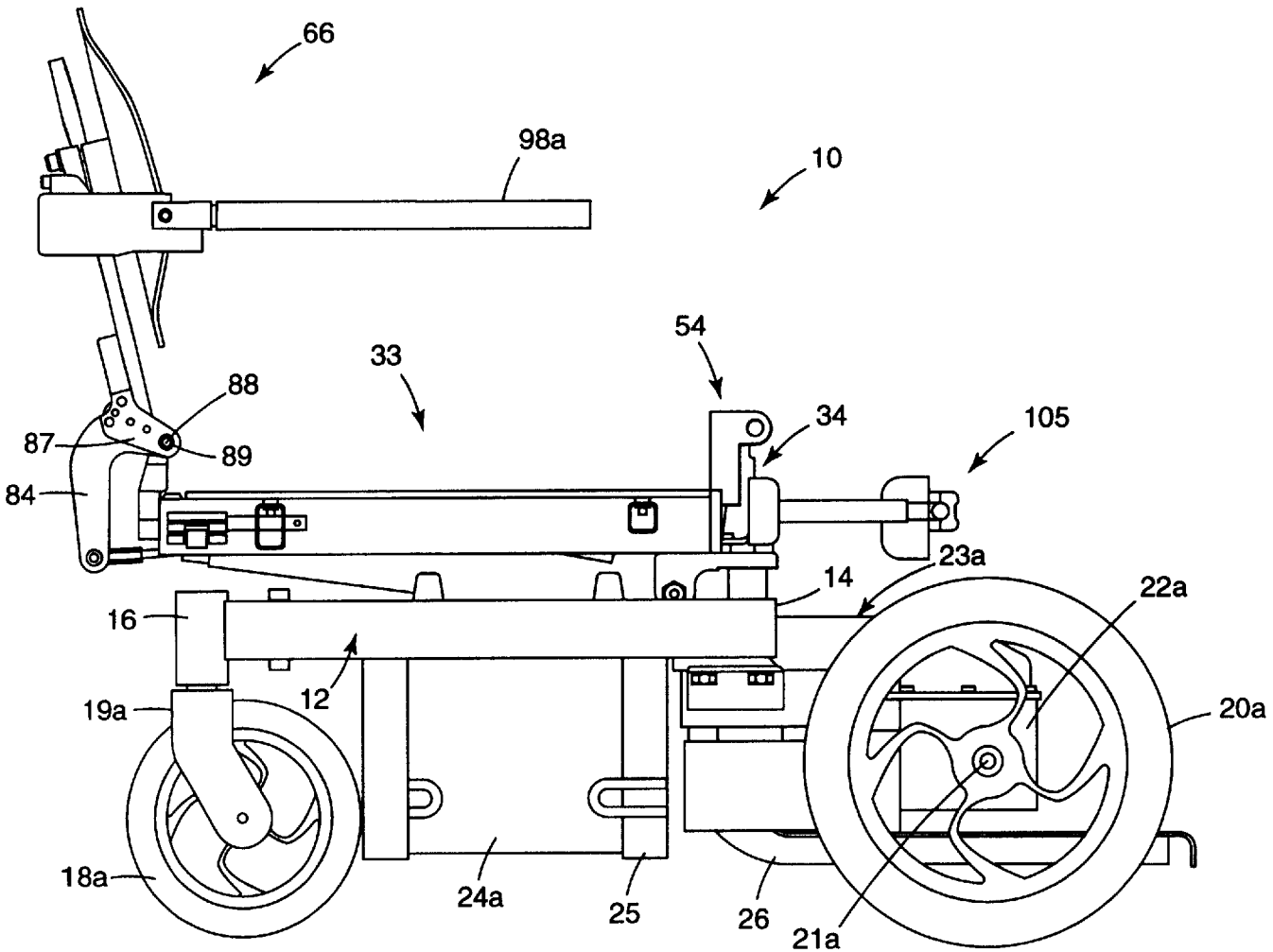
FIG. 1 is a right side view of the wheelchair according to the present invention, with the seat portion in a seated position.
Figure 2:
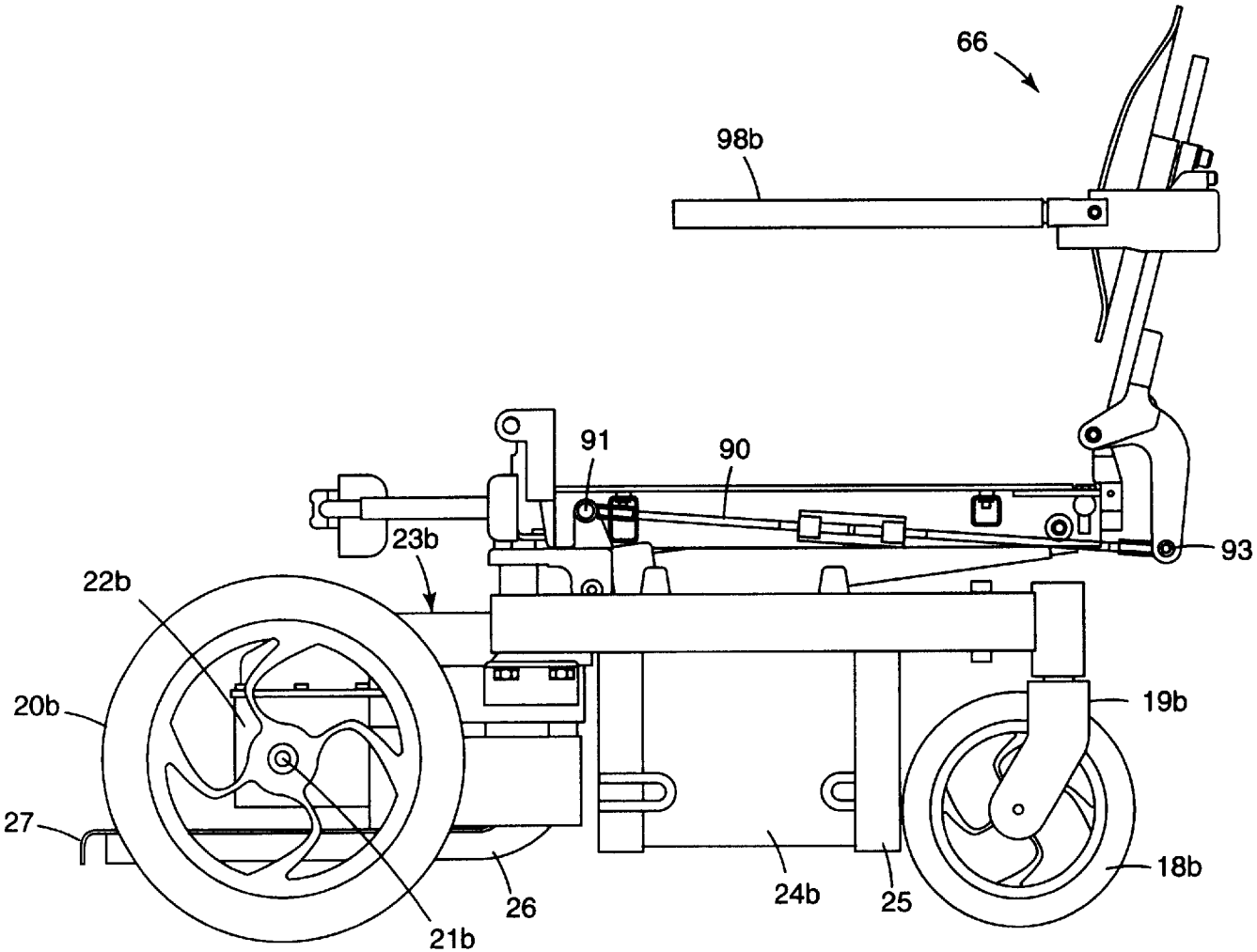
FIG. 2 is a left side view of the wheelchair of FIG. 1.
Figure 3:
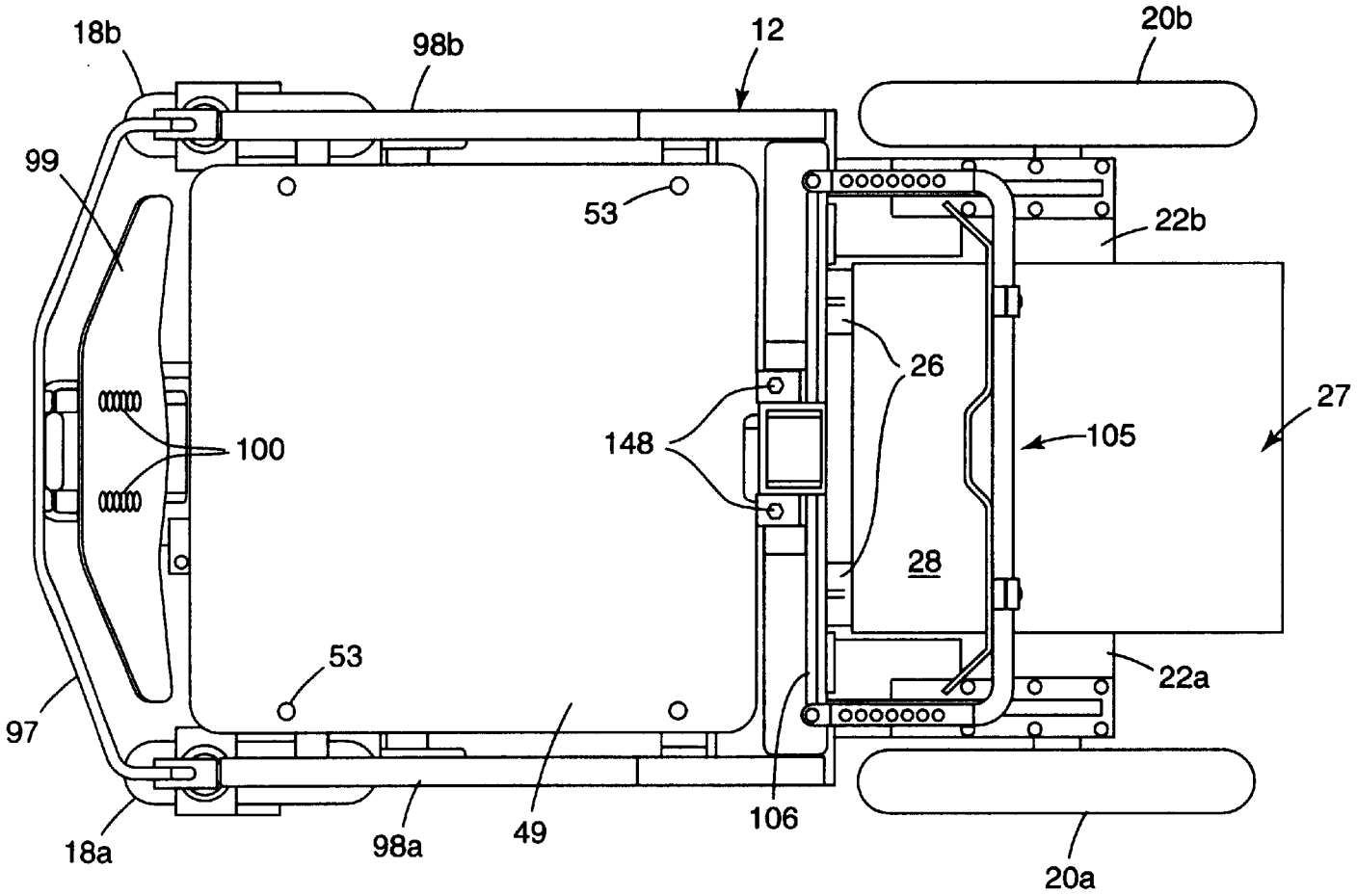
FIG. 3 is a top view of the wheelchair of FIG. 1.

Turning now to FIGS. 1–3, a standing wheelchair 10 is illustrated. The wheelchair includes a rigid, rectangular base frame 12 defining generally a front end 14 and a rear end 16, relative to the intended forward movement direction of the wheelchair. A pair of rear wheels 18*a*, 18*b* are supported for rotation by respective casters 19*a*,19*b*, with each caster 19*a,b* being rotatably mounted in opposite comers of the rear end 16 of the frame in a manner known in the art. The rear wheels 18*a,b* are free to rotate about both horizontal and vertical axes to increase the movement capabilities of the wheelchair. Caster supported wheels are commonly used on wheelchairs, and thus no further description of the wheels and casters is believed to be necessary.

A pair of driveable, front wheels 20*a*,20*b* are disposed at the front of the wheelchair. The wheels 20*a,b* are fixed on respective axles 21*a*,21*b* which are in turn driven by electric motors 22*a*,22*b* that are supported by the front end 14 of the frame by brackets 23*a*,23*b*. The axles 21*a,b* are driven by the motors 22*a,b* in a manner known in the art, so as to rotate the wheels 20*a,b* and cause movement of the wheelchair. Electric power for operating the motors is provided by a pair of rechargeable batteries 24*a*,24*b* supported by brackets 25 underneath the frame between the front and rear pairs of wheels. The batteries are suitably connected to the electric motors for providing electrical power thereto, and operation of the motors can be controlled by a suitable conventional control system of a type known in the art.

A footrest assembly including a pair of support bars 26 and a footrest plate 27 is suitably fixed to the front end 14 of the frame and extends downwardly and forwardly therefrom, for supporting the feet of the user of the wheelchair and facilitating mounting and dismounting of the wheelchair. The plate 27 is generally planar and extends from a location behind the wheels 20*a,b* to a location in front of the wheels 20*a,b*. The portion of the plate 27 that is located behind the axles 21*a,b* forms generally a foot support portion 28 which supports the feet of the user behind the axles when in the seated and standing positions. The portion of the plate 27 located in front of the axles provides a convenient platform to aid a user when mounting or dismounting the wheelchair. A heel positioner can also be mounted on the footrest plate 27 to ensure the proper standing posture of the user.

Figure 14:
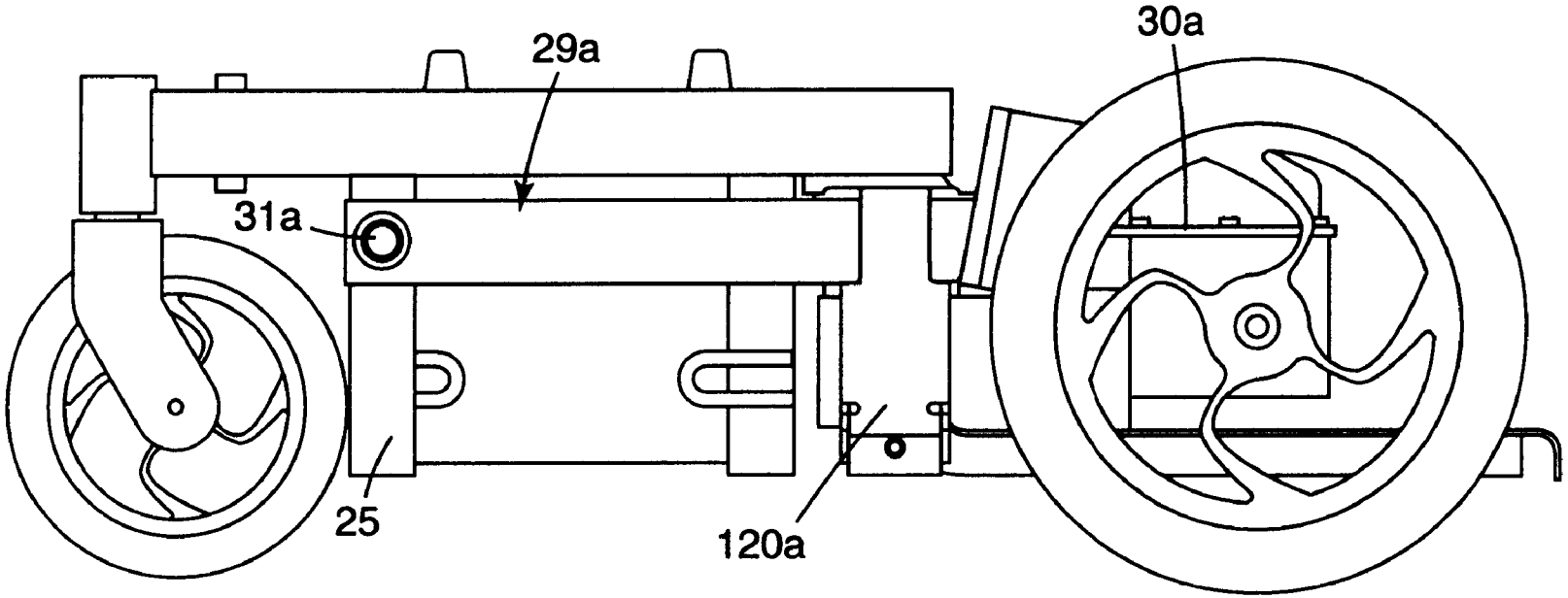
FIG. 14 is a right side view of a portion of an alternate embodiment of the wheelchair according to the present invention, illustrating a suspension system.
Figure 15:
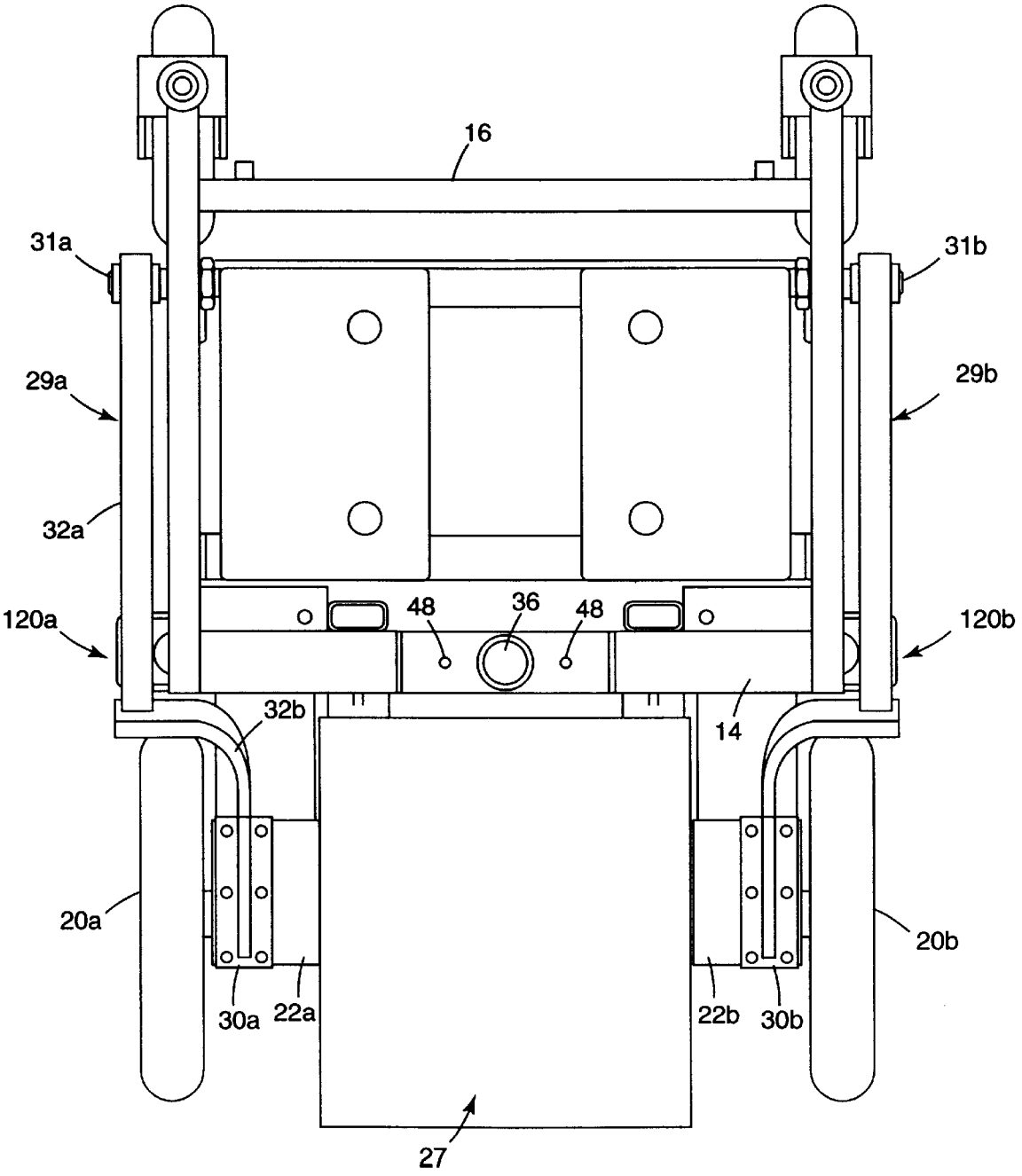
FIG. 15 is a top view of the embodiment shown in FIG. 14.

An alternate embodiment of the wheelchair thus far described is illustrated in FIGS. 14–19, where instead of the front wheels, axles, and electric motors being rigidly connected to the frame by brackets 23*a,b*, a suspension system is provided to resiliently connect the front wheels, axles, and motors to the frame. As shown in FIGS. 14 and 15, the suspension system includes pivot arms 29*a*,29*b* having plates 30*a*,30*b* at one end thereof which are fastened to the tops of the motors 22*a,b*. The opposite ends of the arms 29*a,b* are pivotally attached to the brackets 25 by pivot assemblies 31*a*,31*b* that permit pivoting movements of the arms. Each of the pivot arms 29*a,b* is formed by a first, elongated bar 32*a* extending generally parallel to the axis of the base frame 12, and a second, curved bar 32*b* connected to the front end of the bar 32*a* and being curved inward toward the footrest plate 27 so as to pass around the respective front wheel 20*a,b*. The plates 30*a,b* are attached to the front ends of the curved bars 32*b* and connected to the tops of the motors 22*a,b*, such that the front wheels are pivotable about the pivot assemblies 31,*b* through the pivot arms 29*a,b*.

Figure 17:
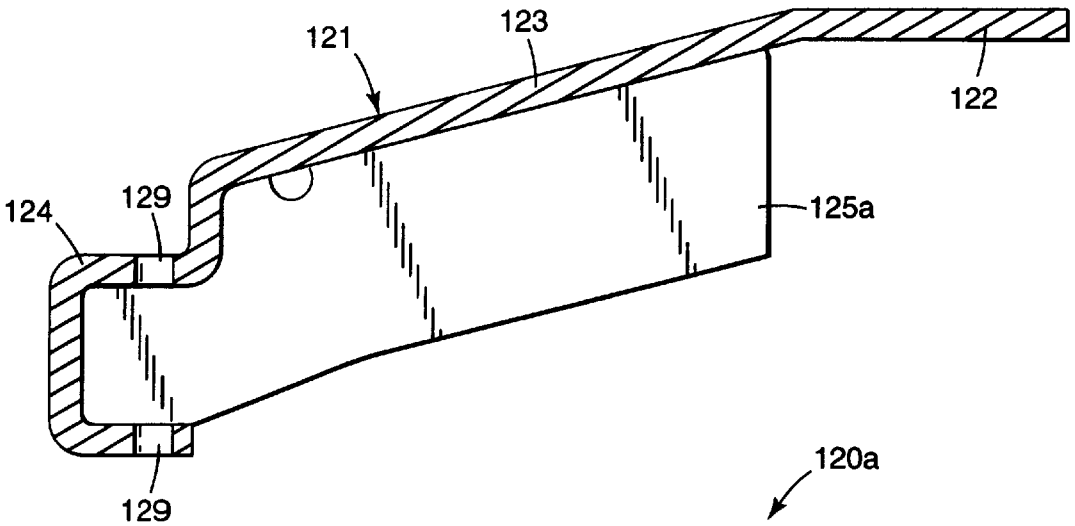
FIG. 17 is a cross-sectional view taken along line 17—17 in FIG. 16.
Figure 18:
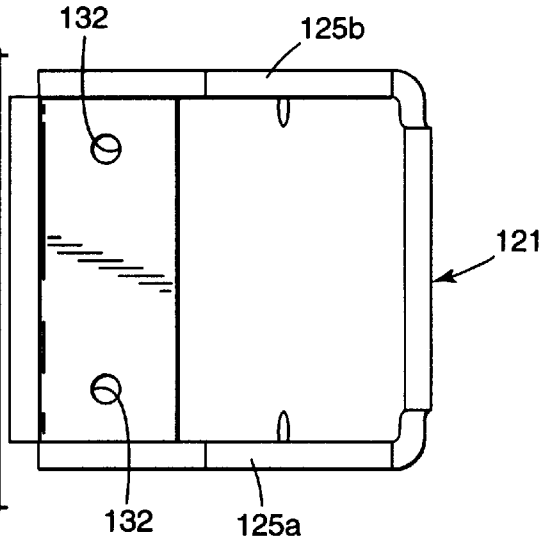
FIG. 18 is a view of the suspension bracket looking generally in the direction of line 18—18 of FIG. 16.
Figure 16:
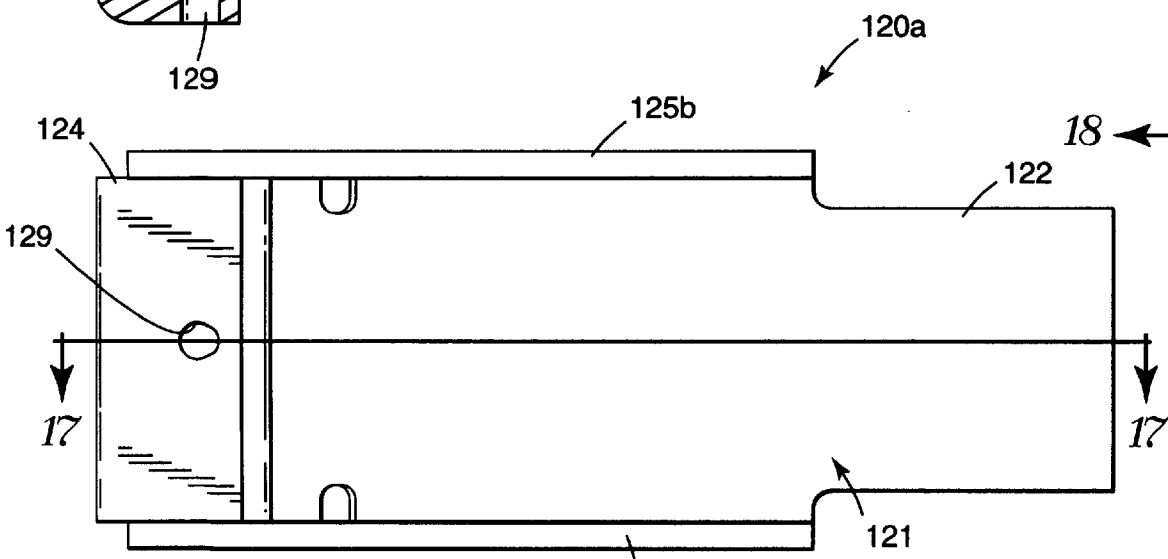
FIG. 16 is a view illustrating a suspension bracket used in the suspension system.

A suspension bracket 120*a*,120*b* is fixed to each pivot arm 29*a,b*, such as by welding, intermediate the ends thereof. The brackets 120*a,b* are identical to each other, so only the bracket 120*a* will be described in detail. With reference to FIGS. 16–18, it can be seen that the bracket 120*a* includes a rear plate 121 having a vertically extending portion 122 at a first end thereof which is attached by welding to the outer surface of the pivot arm 29*a*. The rear plate 121 further includes an angled portion 123 that angles inward from the vertical portion 122, with a U-shaped or cup shaped portion 124 at the second end of the rear plate 121. A pair of side plates 125*a*,125*b* are connected to the rear plate 121 and extend generally from adjacent the vertical portion 122 to the U-shaped portion 124 in order to define a pocket area which receives a shock absorber 126 of the suspension system. When the suspension bracket 120*a* is properly fixed to the pivot arm 29*a*, the vertical portion 122 extends on the outside of the pivot arm, with the pivot arm being disposed on top of the side plates 125*a,b*, as can be seen in FIG. 14. A pair of drain holes 132 are formed in the bottom of the U-shaped portion 124 to allow moisture, dirt and other matter to escape from the U-shaped portion.

Figure 19:
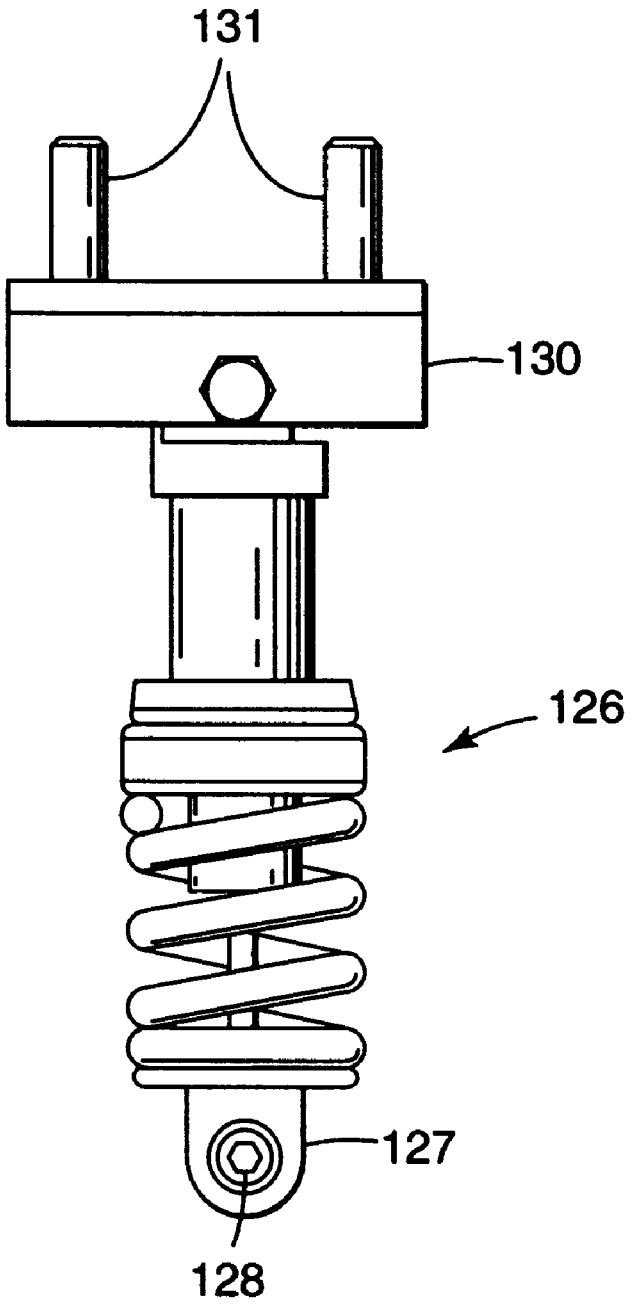
FIG. 19 is a view of a shock absorber that is used in the suspension system.

The shock absorber 126, which is of conventional construction, is best seen in FIG. 19, and includes a first end 127 that is fixed within the U-shaped portion 124 by a fastener 128 that extends through the first end and through aligned holes 129 in the U-shaped portion. The opposite end of the shock absorber 126 is connected to a bracket 130 from which a pair of threaded fasteners 131 extend. The bottom of the base frame 12 is provided with suitably located threaded holes into which the fasteners 131 are threaded to permit securement of the opposite end of the shock absorber to the frame. Thus the end 127 of the shock absorber is fixed to the suspension bracket, while the opposite end is fixed to the base frame. Thus each front wheel is independently supported in a resilient manner by the suspension system, so that as the front wheels encounter obstacles, such as bumps or holes, while traveling, the jolts caused by the obstacles are transmitted by the pivot arms to the suspension brackets and thus to the first end 127 of the shock absorber. Since the opposite end of the shock absorber is fixed to the frame, the shock absorber absorbs the jolts, thus improving the ride quality of the wheelchair.

Returning now to FIGS. 1–3, and FIGS. 4–10, it can be seen that a seat assembly is connected on top of the frame 12 at the front end 14 thereof. The seat assembly includes a seat portion 33 that is connected to the front end of the frame via a front pivot assembly 34 and seat pivot 54, for pivoting movements between a generally horizontal, seated position, illustrated in FIGS. 1–3, and a raised, angled standing position, illustrated in FIGS. 4–5. The seat assembly further includes an actuator 60 connected thereto for actuating the seat portion 33 between the seated and standing positions.

Figure 6:
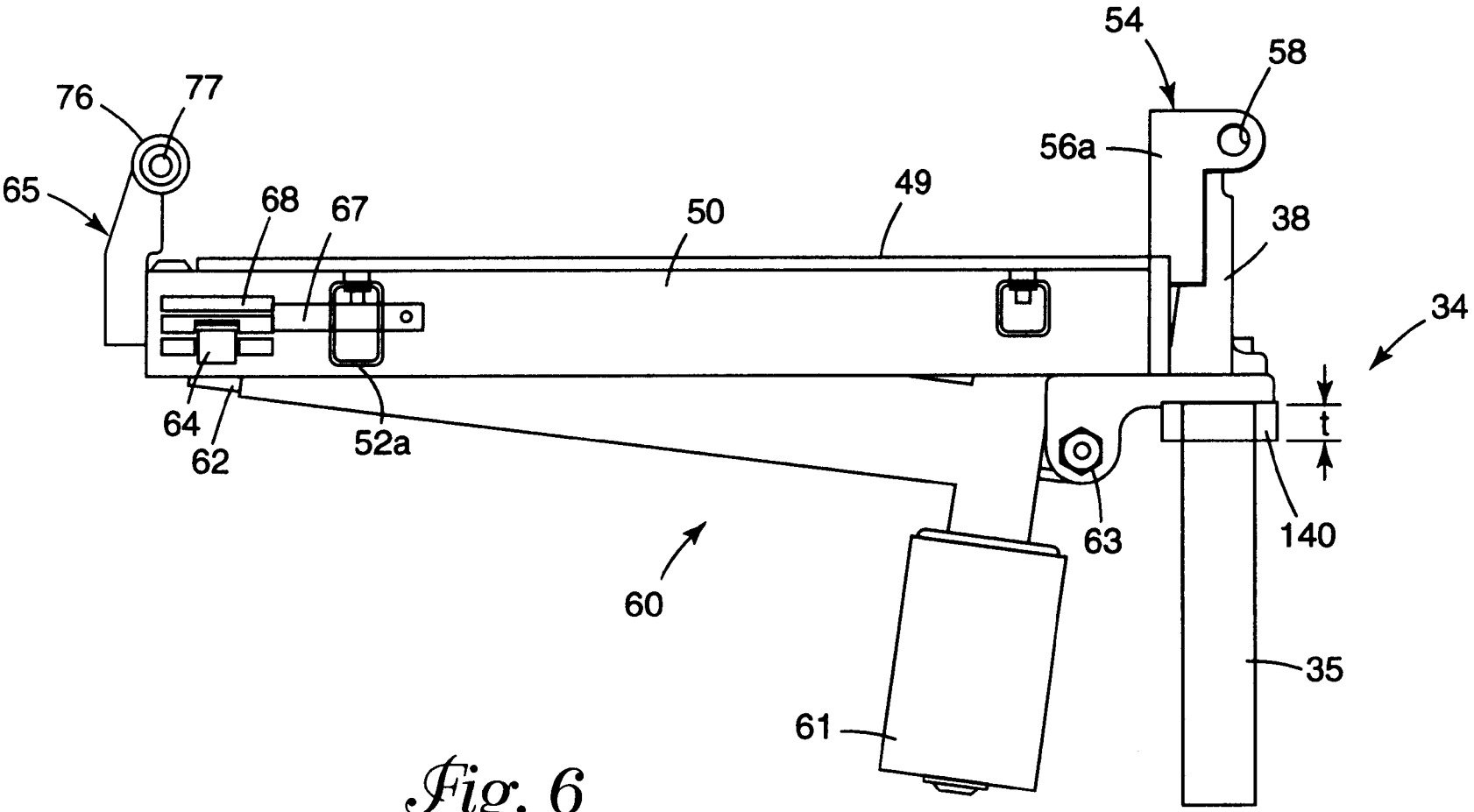
FIG. 6 is a detailed right side view illustrating the seat assembly.
Figure 7:
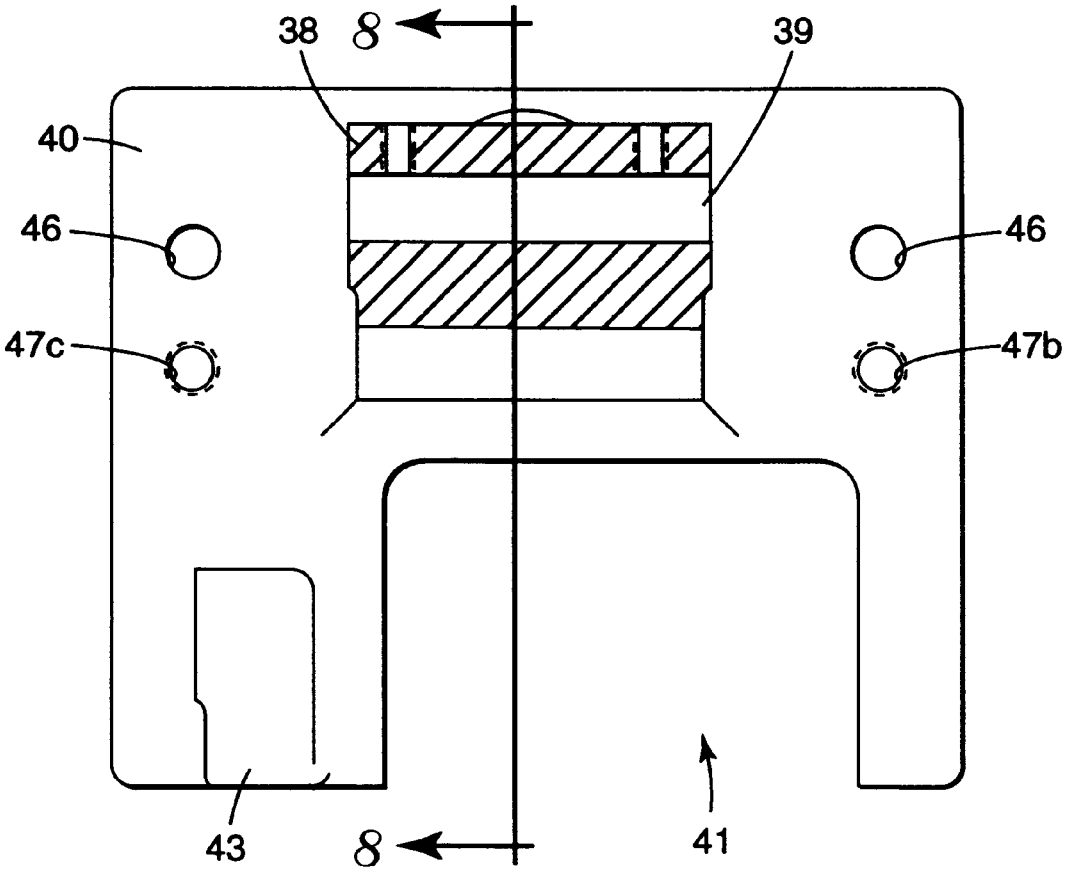
FIG. 7 is a cross-sectional view of the front pivot column taken along line 7—7 of FIG. 8.
Figure 8:
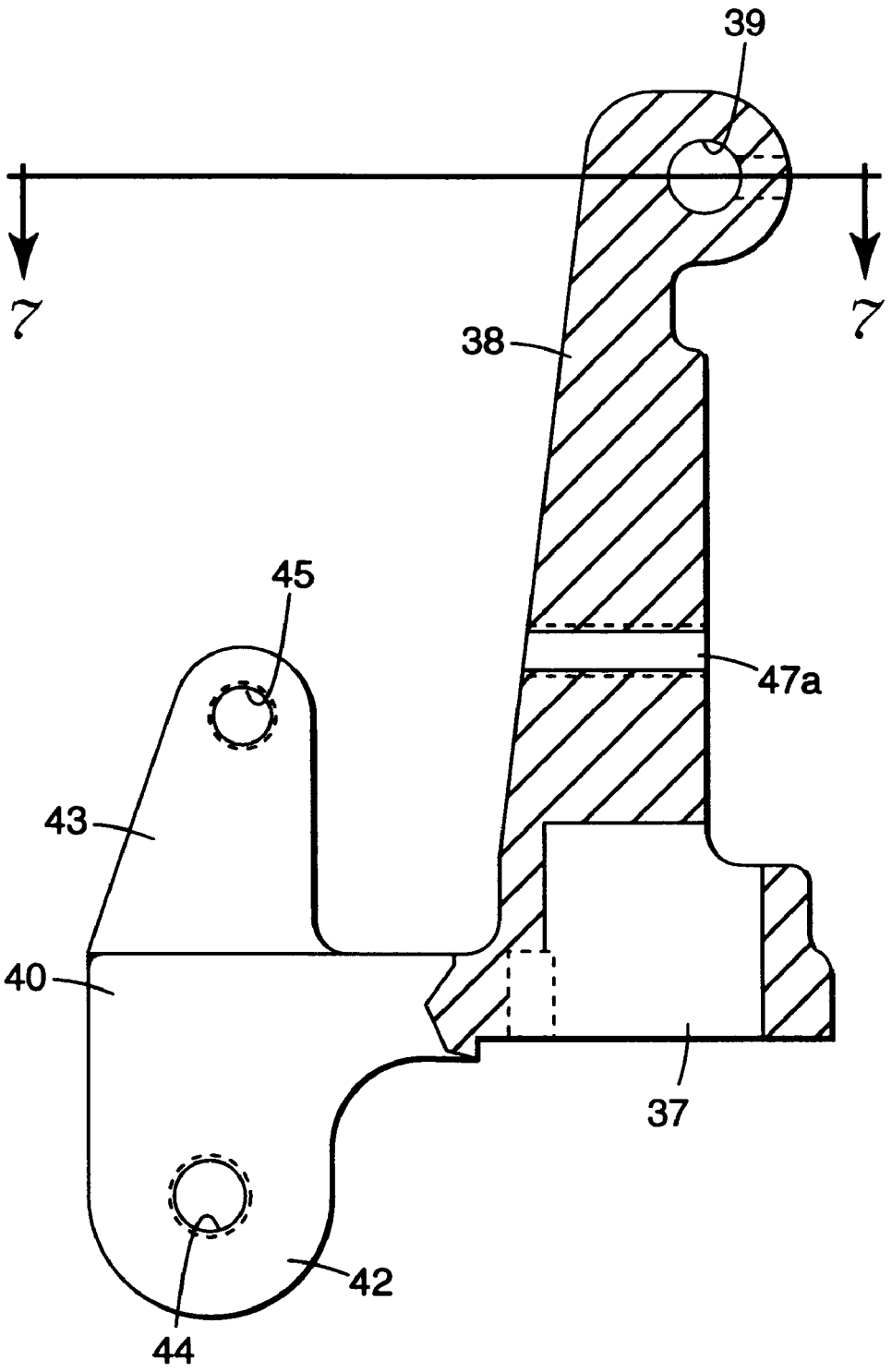
FIG. 8 is a cross sectional view taken along line 8—8 of FIG. 7.

The front pivot assembly 34 includes a support post 35 (see FIG. 6), one end of which is fixedly received within an aperture 36 (best seen in FIG. 15) at the center of the front end 14 of the frame, and the other end of which is fastened within an aperture 37 (seen in FIG. 8) formed in the bottom of a front pivot column 38. As shown in FIGS. 7 and 8, the pivot column 38 includes a horizontally extending hole 39 adjacent the top end thereof, and a skirt portion 40 at the base end thereof. The skirt portion 40 has a cut-out 41 section, with a pair of flanges 42 (only one being shown in FIG. 8) extending downward from the skirt portion on either side of the cut-out section 41, and a single flange 43 extending upwardly from the skirt portion. A hole 44 is formed through each flange 42, and a hole 45 is formed through the flange 43, the purposes of which will be later described. A pair of holes 46 are also formed through the skirt portion 40 and are aligned with a pair of corresponding threaded holes 48 (seen in FIG. 15) in the front end 14 to permit attachment of the skirt portion to the front end 14 by suitable fasteners, such as bolts, screws or the like, extending through the holes 46 and into the threaded holes 48. Three threaded holes 47*a*, 47*b*, 47*c* are also provided through the pivot column 38 and the skirt portion 40, the purposes of which will be later described.

The front pivot assembly 34 is thus fixed to the front end of the frame by inserting the post 35, the top end of which is secured within the aperture 37 in the bottom of the pivot column 38 such as by welding, into the hole 36 in the front end of the frame 12. The holes 46 are then aligned with the holes 48, and fasteners inserted into the aligned holes to secure the skirt portion 40 to the frame. Since the front pivot assembly 34 is the only connection between the frame and the rest of the seat assembly, the entire seat assembly, which is shown in FIG. 6, can be removed as a unit from the frame by removing the fasteners that secure the skirt portion and then lifting the seat assembly until the post 35 is removed from the hole 36. A different seat assembly, which can either be a pivoting version or a permanently seated version, can then be mounted on the base frame. As should be apparent then, the base frame 12 can be standardized, with a variety of different seat assemblies being mountable thereon. The wheelchair 10 described herein can therefore be used with interchangeable seat assemblies, in order to accommodate different users, or the different preferences of an individual user.

Further, the front pivot assembly 34 sets the height of the seat portion 33 by controlling the height of the pivot column 38 above the frame. Incremental adjustments of the height of the pivot column 38, and therefore of the seat portion 33, can be achieved by using a cylindrical spacer 140 disposed around the post 35 (see FIG. 6). The spacer 140 rests on top of the front portion 14 of the frame when the post 35 is inserted into the hole 36, such that the skirt portion 40 is raised vertically upward, thereby raising the height of the seat portion 33. The thickness t of the spacer 140 is preferably selected to achieve a height of the seat portion that is best suited to the individual user of the wheelchair. However, instead of using a single spacer 140, a plurality of spacers can be used to achieve the desired height of the seat portion.

Figure 5:
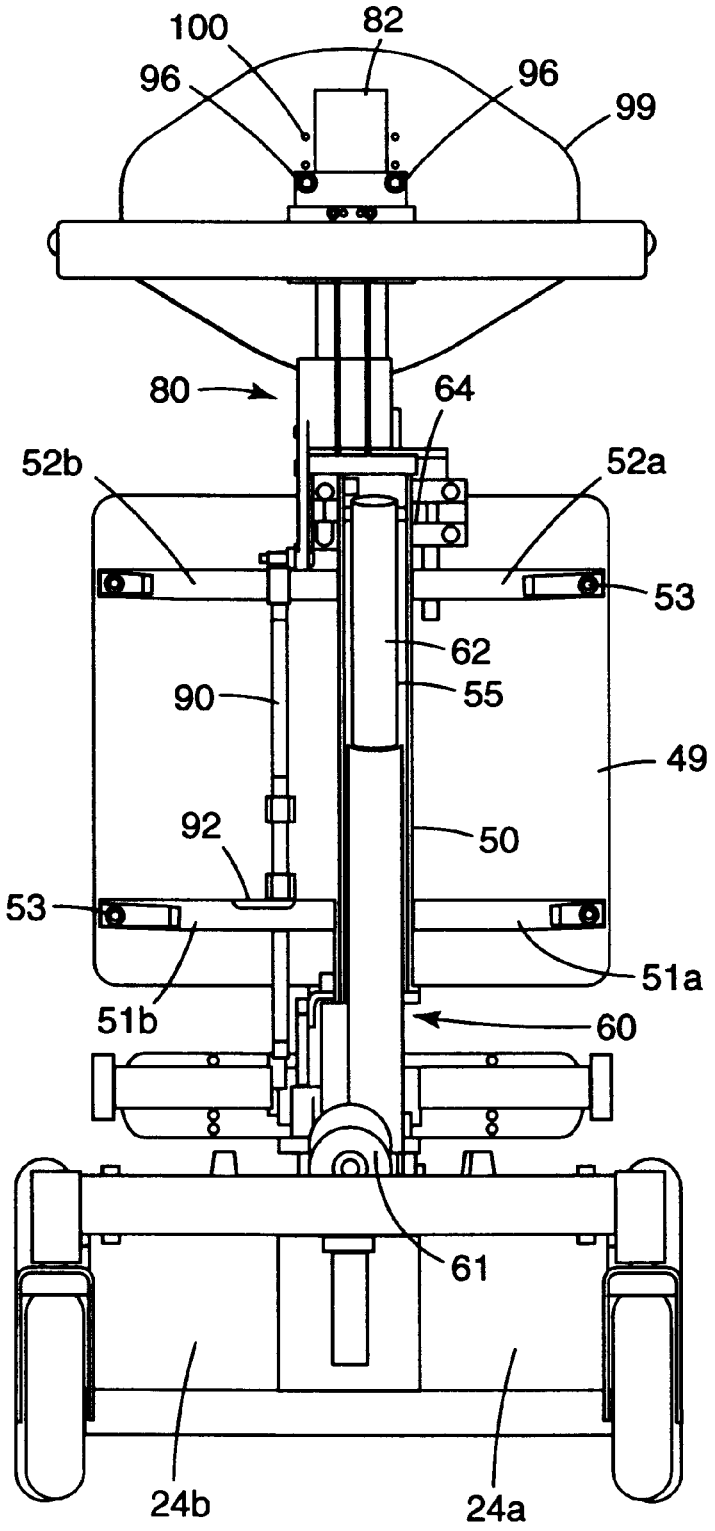
FIG. 5 is a view of the wheelchair in FIG. 4, looking from the rear.
Figure 6A:
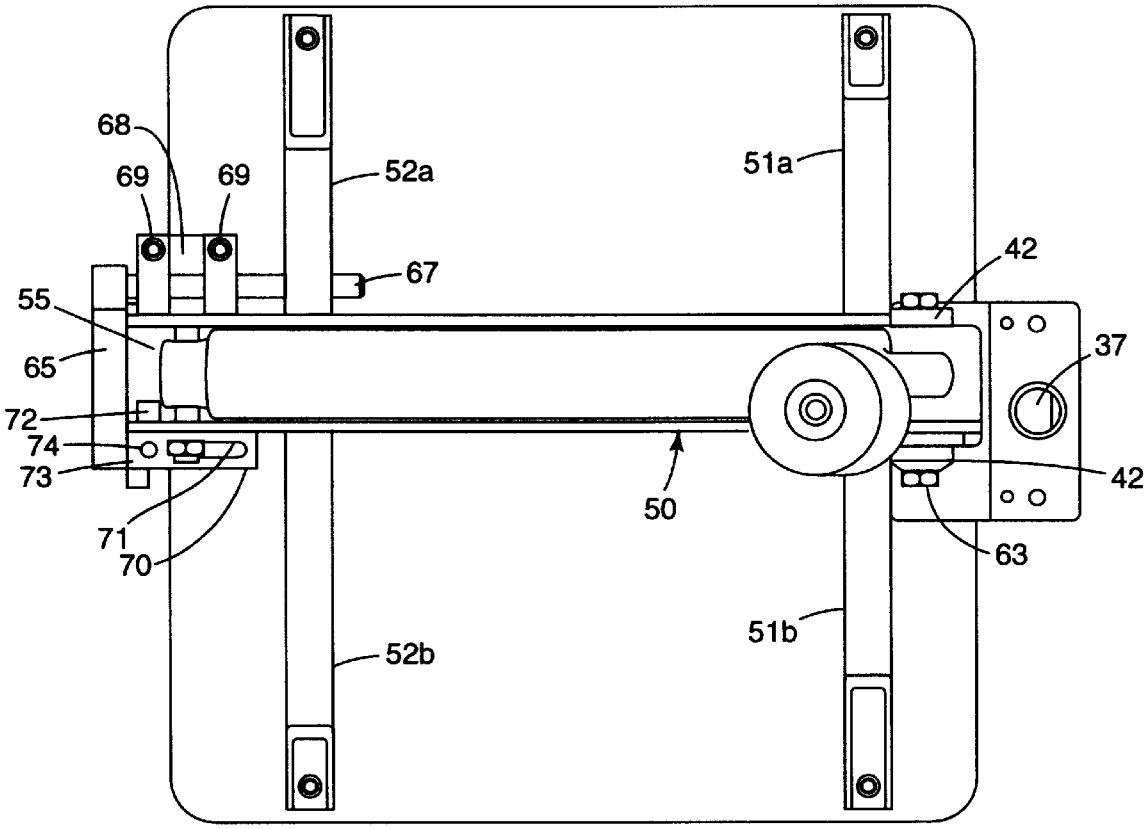
FIGS. 6*a* and 6*b* are bottom and left side views, respectively, of the seat assembly shown in FIG. 6.

The seat portion 33 includes a planar seat plate 49 which is supported on top of a seat support bar 50 extending parallel to a longitudinal axis of the wheelchair. As best seen in FIGS. 5 and 6*a*, the seat support bar 50 is located slightly to the right of the center of the plate 49, and includes a downwardly facing channel 55. A pair of front support members 51*a*,51*b* (see FIGS. 5, 6*a* and 9) extend from the seat support bar proximate the front end thereof, and a pair of rear support members 52*a*,52*b* extend from the seat support bar proximate the rear end thereof. The seat plate 49 is mounted on the support member 51*a,b* and 52*a,b* by fasteners 53, such as bolts, screws or the like. A seat cushion or pad, not shown, would normally be placed on top of the plate 49 for the user to sit on during use, with the top surface of the seat cushion or pad being approximately level with the top of the seat pivot 54 and pivot column 38.

Figure 9:
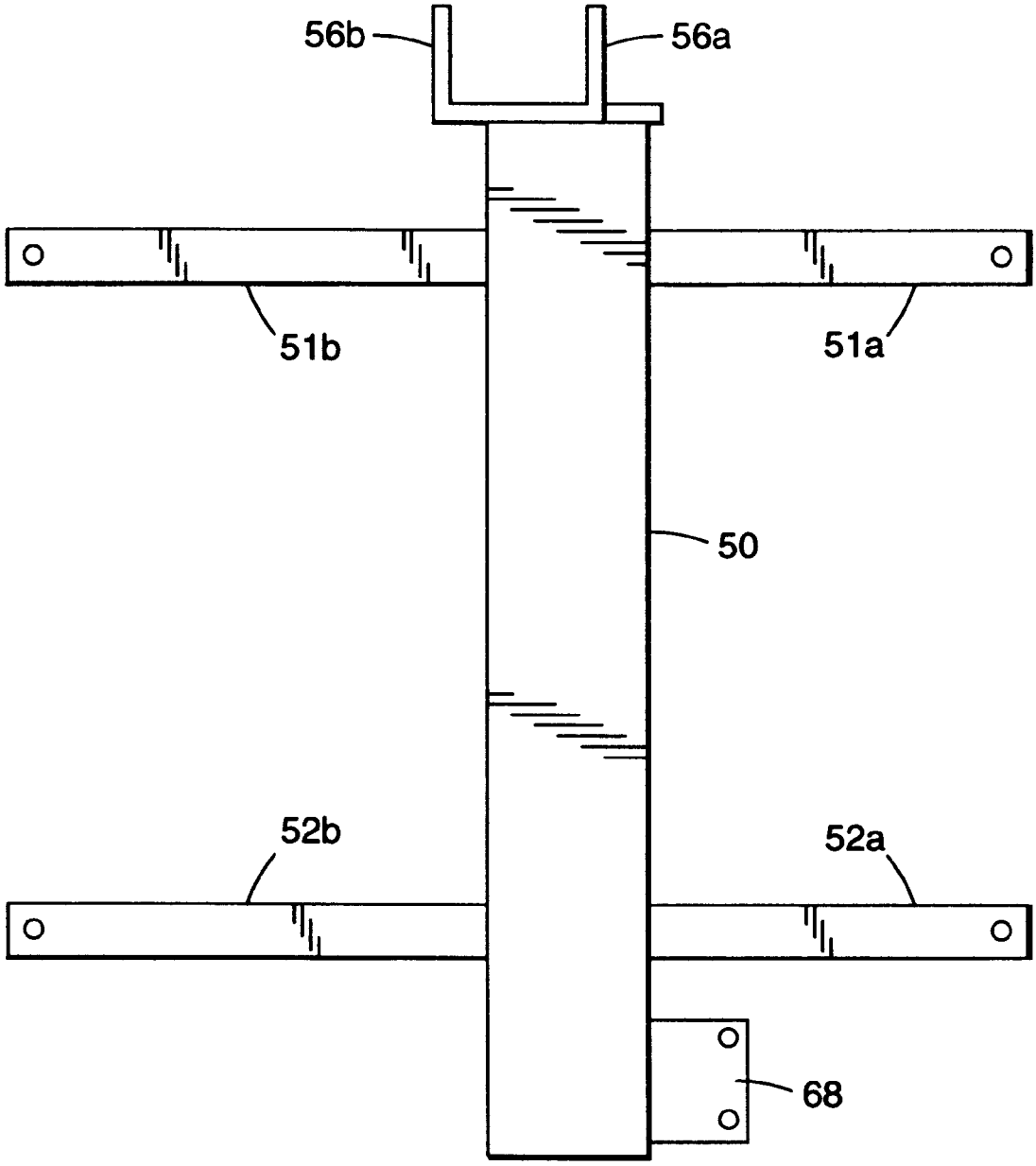
FIG. 9 is a top view of the seat support bar and other elements of the seat portion.
Figure 10:
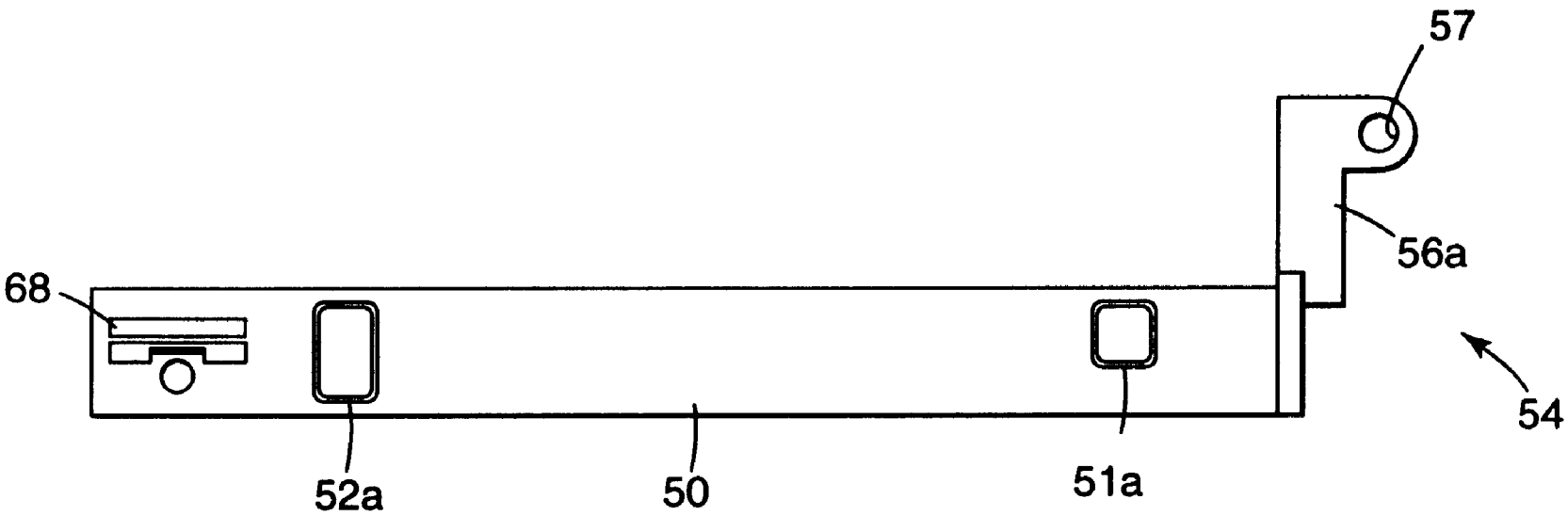
FIG. 10 is a side view of FIG. 9.

Referring now to FIGS. 6, 6*b*, 9 and 10, the seat pivot 54 is connected to the front end of the seat support bar 50 for connection to the pivot column 38. The seat pivot 54 is bifurcated so as to define a pair of ears 56*a*,56*b*, with each ear having an aperture 57 provided therein. As seen in FIG. 9, the ears 56*a,b* are not equidistant on either side of the central axis of the seat support bar 50, so that the ears are able to align with the centrally located pivot column 38. The apertures 57 in the ears 56*a,b* are aligned with the aperture 39 in the pivot column, and a stub pivot shaft 58 is inserted into the aligned apertures so that the seat portion 33 is pivotally attached to the pivot column 38. Since the seat pivot 54 is bifurcated, the body of the pivot column 38 can be received between the ears 56*a,b* to permit unimpeded pivoting of the seat pivot relative to the pivot column. Further, the upwardly extending flange 43 on the skirt portion 40 of the pivot assembly 34 is located sufficiently to the side of the pivot column 38 such that the flange 43 will be located to the left of the seat support bar 50, and thus not impede pivoting movements of the seat portion 33.

Thus, as should be apparent to one having ordinary skill in the art, the stub pivot shaft 58 is centrally located at the front of the seat portion 33, so that when a user is seated on the wheelchair, the stub pivot shaft is located between the user's knees. Further, as stated previously, the top of the seat cushion that is disposed on the seat plate will be approximately level with the stub pivot shaft. Therefore the pivot axis of the seat portion is located closer to the axis of the user's knees, thereby reducing shear on the user as the seat portion pivots between the seated and standing positions. In addition, by using a single, centrally located stub pivot shaft 58 to allow pivoting movements of the seat portion 33, the number of parts is reduced and the structure of the chair is simplified.

Referring now to FIGS. 5, 6, 6*a*, and 6*b*, the actuator 60 for actuating the seat portion between the seated and standing positions is disposed underneath the seat portion. The actuator 60 is preferably an electric actuator and includes an electric motor 61 causing extension and retraction of a rod 62. The actuator 60 is preferably provided with suitable gearing so as to convert a rotary output of the motor 61 into extension or retraction of the rod 62. Actuators of this type are well known, and thus the details of the actuator 60 are not further described.

Figure 4:
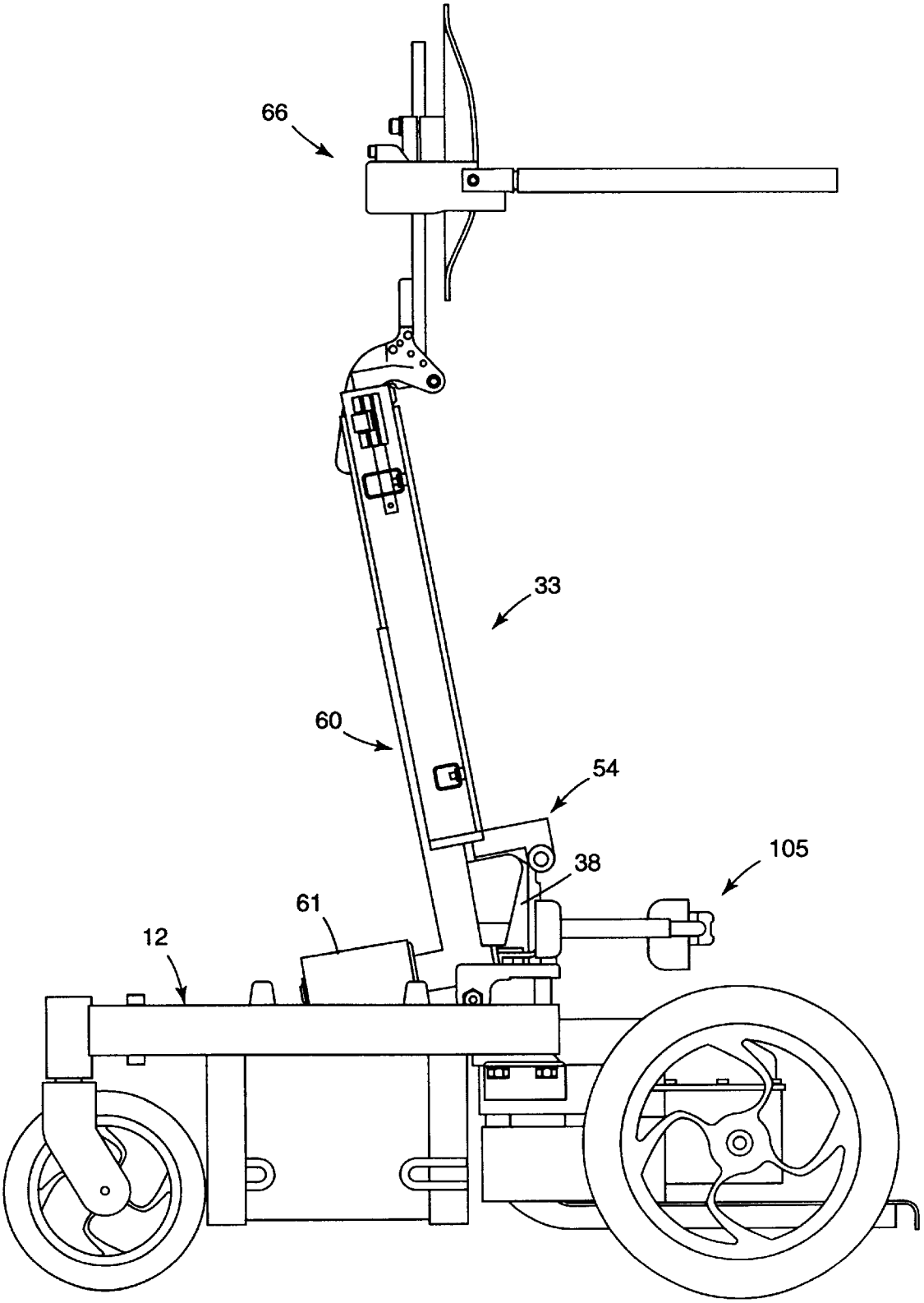
FIG. 4 is a view similar to FIG. 1, but with the seat portion pivoted to the standing position.

The actuator 60 is disposed at one end within the cut-out section 41 of the skirt portion 40, and it is pivotally connected between the flanges 42 by a pivot 63, as best seen in FIG. 6. At the other end of the actuator, the rod 62 is disposed within the channel 55 of the seat support bar 50 at the rear end thereof and is pivotally attached thereto by a fastener 64. The actuator 60 is generally aligned with the axis of the seat support bar, and pivots about the pivot 63 as the seat portion 33 is pivoted to the standing position, so that a substantial portion of the actuator is disposed within the channel 55 of the seat support bar. Therefore, as can be seen in FIG. 4, a substantial portion of the actuator is hidden within the channel of the seat support bar, thus improving the visual appearance of the wheelchair.

It can also be seen from FIGS. 1–5 that there are not any linkages that extend directly between the seat portion 33 and the base frame 12 as is common in conventional standing wheelchairs. Normally, such linkages would have to be disconnected from either the frame or the seat portion before the seat assembly could be removed. Since there are no linkages, the seat assembly of the present invention can be easily removed from the base frame by lifting the seat assembly until the post 35 is removed from the hole 36 in the manner previously described, without first disconnecting any linkages. Further, since all linkages between the seat portion and base frame are eliminated, the number of mechanical parts is reduced, the structure is simplified, and the visual appeal of the wheelchair is enhanced.

Figure 6B:
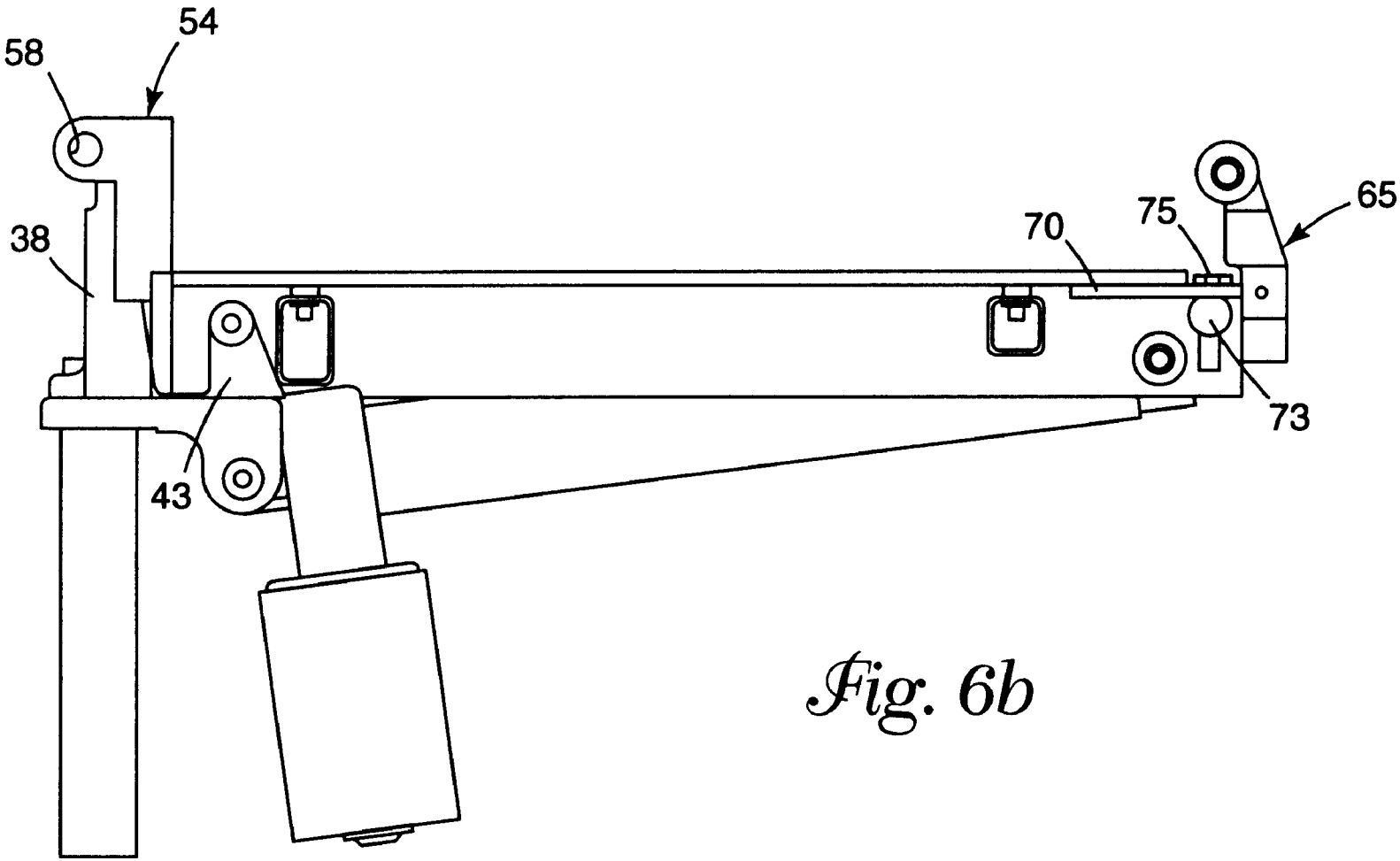

A connector 65 is fastened to the rear end of the seat support bar for connecting a back support assembly 66 to the seat portion. As best seen in FIGS. 6, 6*a*, and 6*b*, the connector 65 includes a pin 67 extending therefrom on one side of the seat support bar. The pin 67 extends through a guide 68 secured to the seat portion, and through a hole (not shown) provided in the rear support member 52*a*. The guide 68 is in the form of a clamp structure having a pair of clamping bolts 69 that can be tightened around the pin 67 to lock the pin in place, or loosened to permit sliding movement of the pin within the guide 68. A flat plate 70 extends from the connector 65 on the other side of the seat support bar, and the plate 70 includes an elongated adjustment slot 71 formed therein. The seat support bar includes a hole therein (not shown), just to the rear of the fastener 64, and a reduced diameter end 72 of a locking peg 73 is secured within the hole such that the peg 73 is disposed underneath the plate 70. The locking peg includes a threaded hole 74 formed therethrough which receives a locking bolt 75. It should be apparent that the position of the connector, and thus the position of the back support assembly 66, can be adjusted relative to the seat portion by loosening the bolts 69 and 75. The connector 65 can then be slid either forward or backward to the desired position, aided by the guide 68 and the elongated slot 71, and then secured in position by tightening the bolts 69,75. Since each user has a different body size, the above described connection permits adjustments to accommodate various knee-to-hip lengths. The connector 65 further includes a cylindrical top portion 76 having a hole 77 extending therethrough.

The connection between the back support assembly 66 and the connector 65 is best illustrated in FIGS. 1–2, 13 and 13*a*–*c*. The assembly 66 includes a pivot bracket 80 at a bottom end thereof having a planar central portion 81 that is secured in any appropriate manner to a vertically extending back support column 82. The left side of the central portion 81 includes a first finger 83 integral therewith which extends downward and forward and a second finger 84 integral therewith which extends downward and slightly to the rear. The end of each finger 83,84 is provided with a hole 85,86, respectively. As shown in FIG. 1, a pivot plate 87 is securely fixed to the right side of the central portion 81, opposite the first finger 83, and includes a hole 88 therethrough that is aligned with the hole 85. The first finger 83 and the plate 87 are spaced a sufficient distance to permit the cylindrical portion 76 of the connector to be disposed therebetween. The holes 77,85,88 are then aligned and a pivot pin 89 is inserted through the holes to pivotally connect the back support assembly to the connector 65, and thus to the seat portion 33.

An adjustable length linkage 90 is pivotally connected at one end thereof to the flange 43 of the front pivot assembly 34 by a pivot pin 91 or the like extending through the hole 45 and connecting to the linkage 90. The linkage 90 extends through an elongated hole 92 in the front support member 51*b*, and is pivotally connected at its opposite end to the finger 84 by a pin 93 or the like. The linkage 90 is adjustable in length to accommodate the adjustable positioning of the back support assembly relative to the seat portion. The linkage 90 ensures that the back support assembly 66 pivots with the seat portion 33 during the movements between the seated and standing positions. In the initial seated position, illustrated in FIGS. 1–2, the seat portion 33 is generally horizontal while the back support assembly 66 is slightly rearwardly angled relative to the ground. As the seat portion 33 is pivoted upward to the standing position, the back support assembly 66 simultaneously pivots about the pivot 89 due to the linkage 90. Once in the standing position, the seat portion is in a raised, angled position less than fully vertical, preferably approximately 10 degrees from vertical. On the other hand, the back support assembly at the standing position is vertically disposed relative to the ground, as seen in FIG. 4. Applicant has found that by positioning the seat portion at approximately 10 degrees from vertical and positioning the back support assembly vertically, user comfort is maximized at the standing position, the reaching capability of the user is improved, and pressure and shear on the user's knees are reduced.

With reference now to FIGS. 13 and 13*a–c*, an adjustable slide 95 is disposed on the support column 82 for sliding movements up and down thereon. The slide 95 is adjustably fixed on the column 82 by bolts 96 which clamp the slide in position on the column, and which permit sliding movements of the slide 95 up and down on the column when the bolts 96 are loosened.

Figure 13:
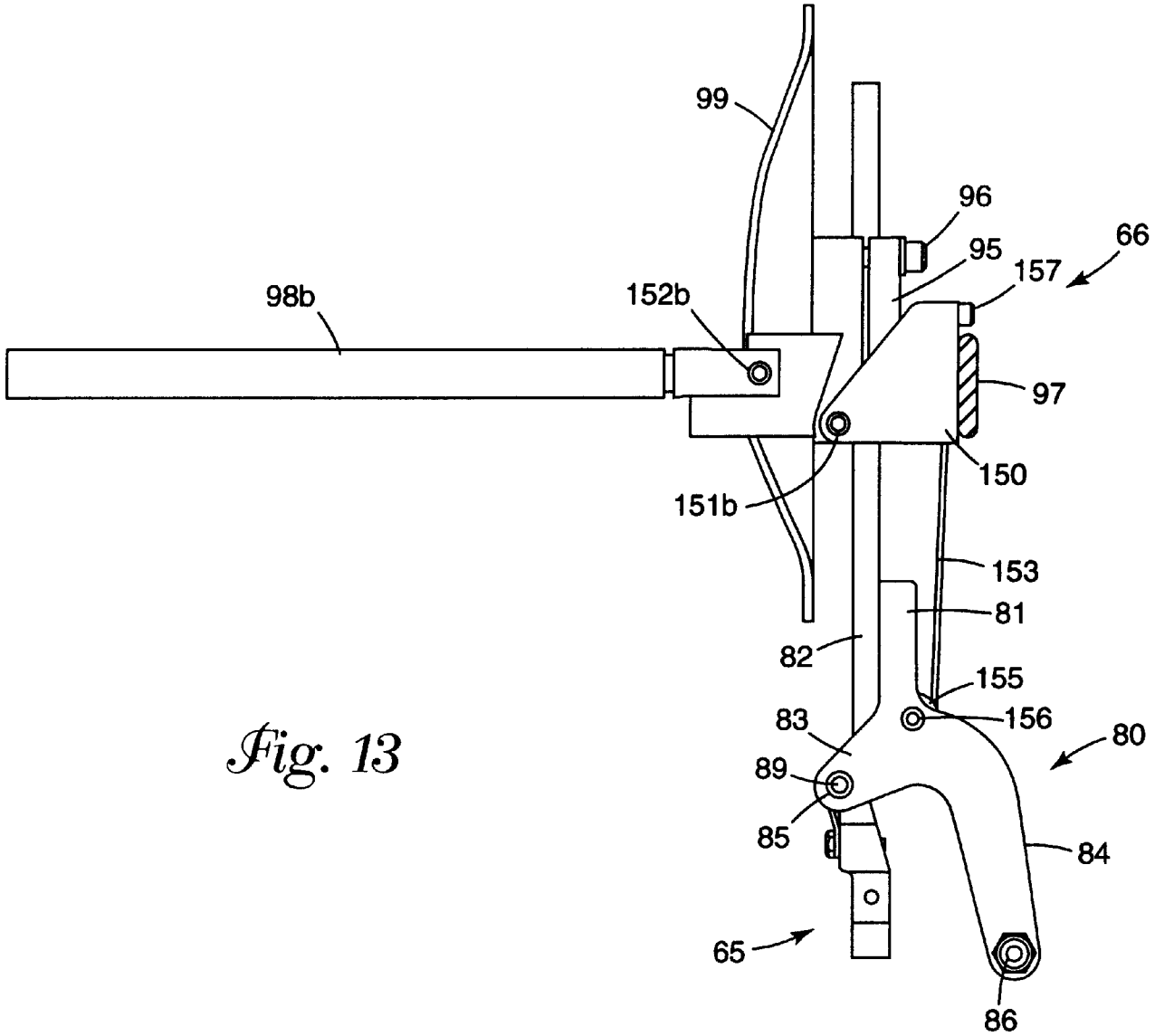
FIG. 13 is a left side view of the back support assembly with a portion thereof broken away to illustrate the pivoted connection between the arm rest support member and the slide.
Figure 13A:
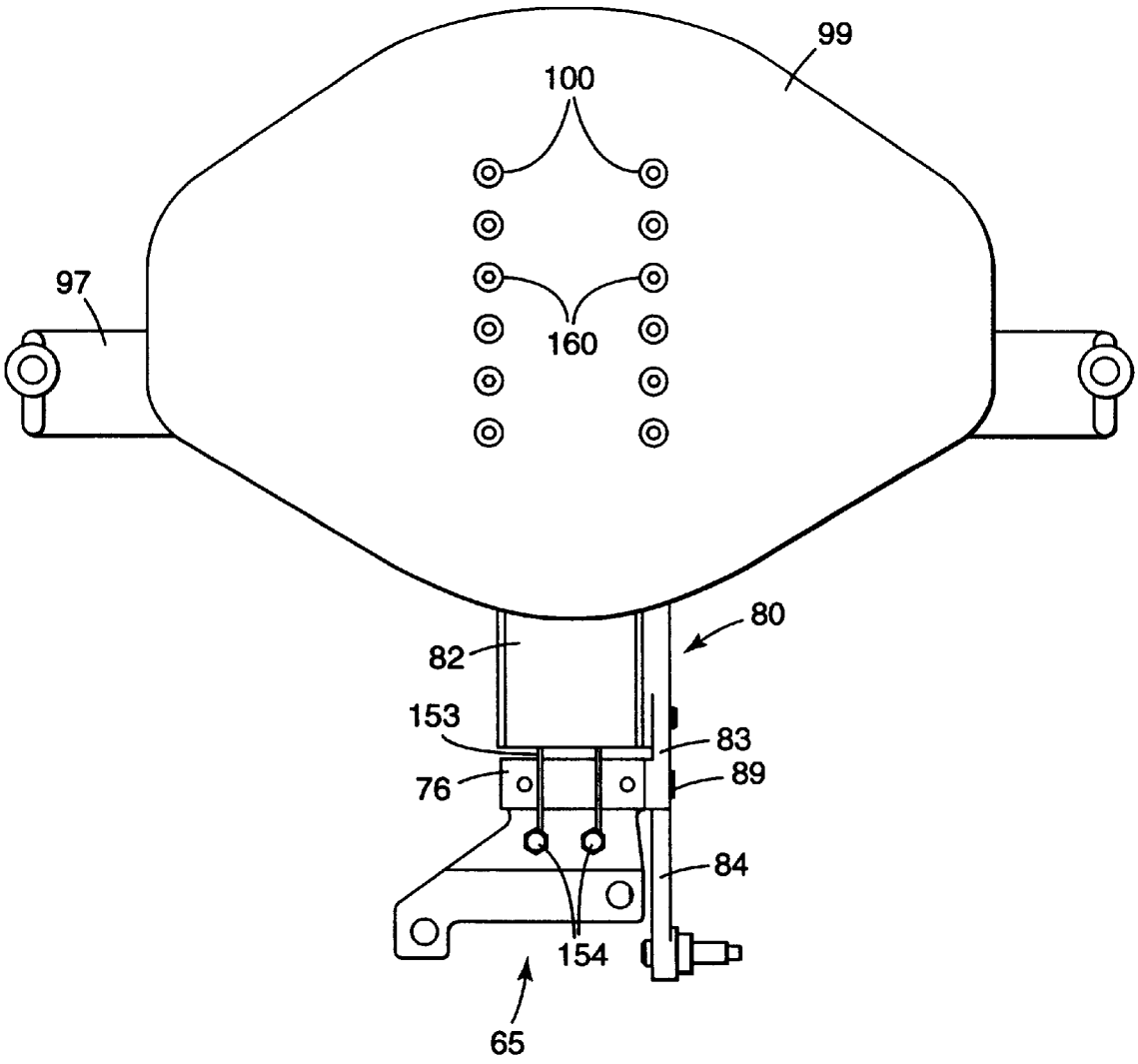
FIG. 13*a* is a front view of the back support assembly of FIG. 13.
Figure 13B:
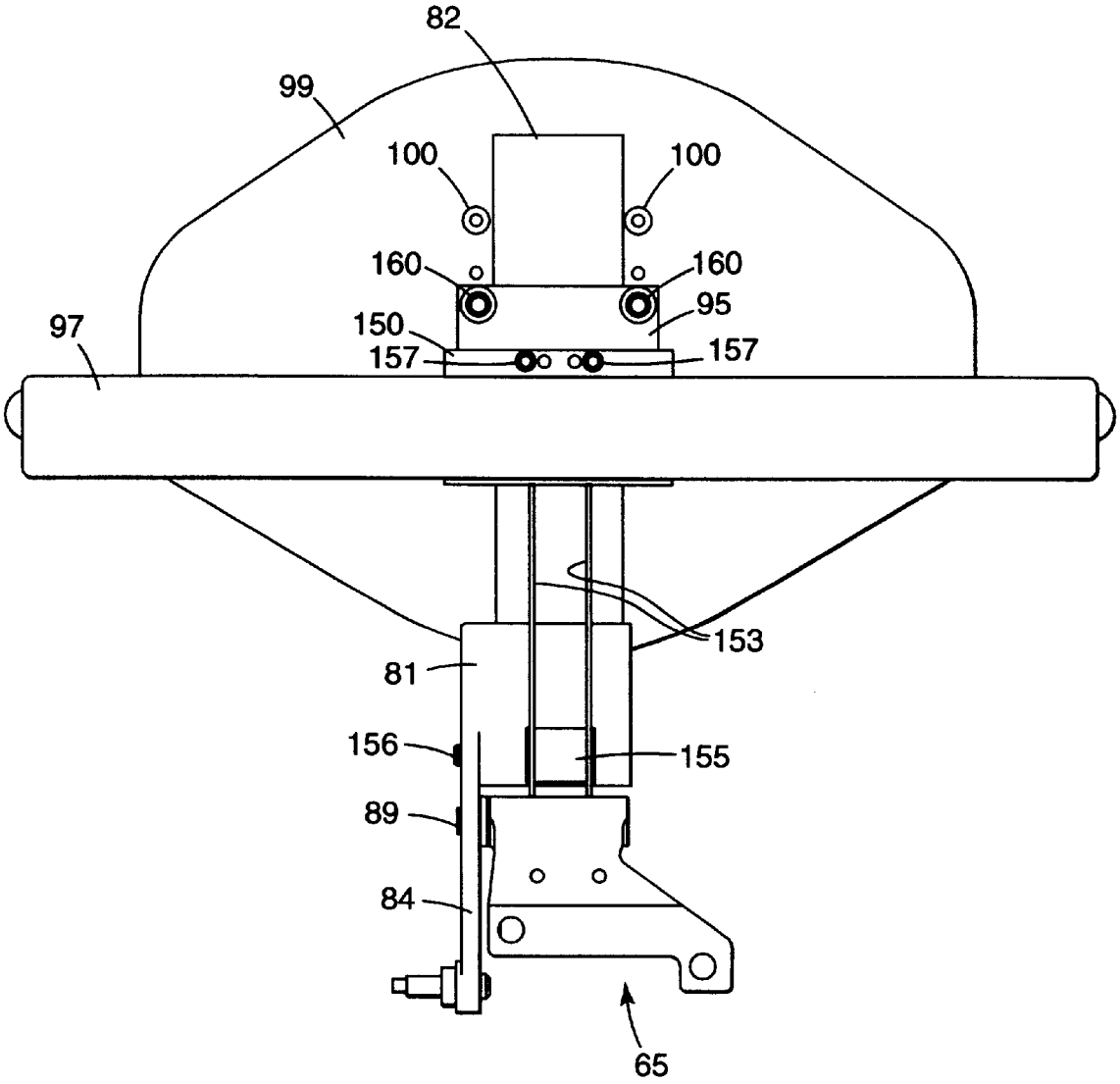
FIG. 13*b* is a rear view of the back support assembly.
Figure 13C:
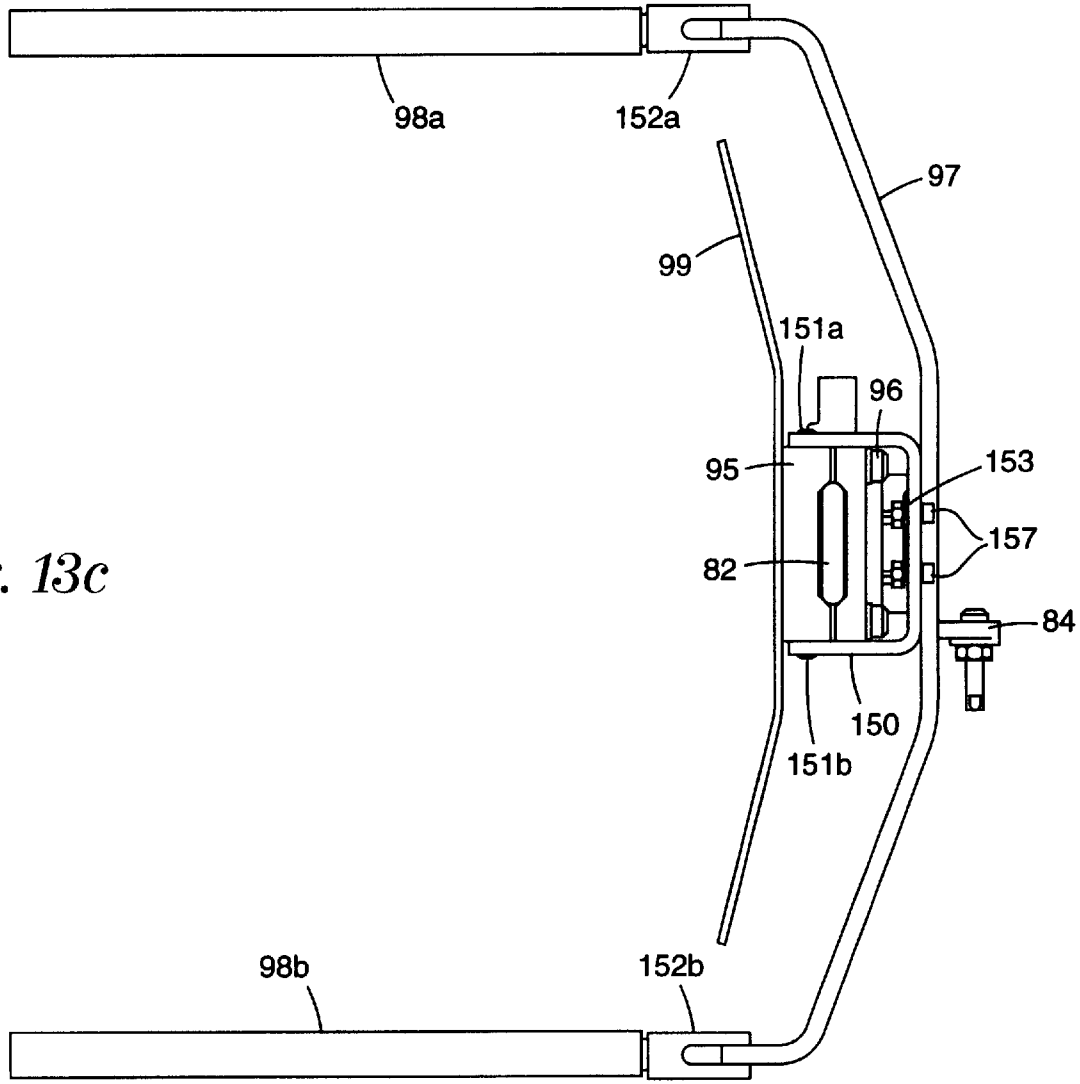
FIG. 13*c* is a top view of the back support assembly.

As best seen in FIGS. 13 and 13*c*, a U-shaped bracket 150 is disposed around the slide 95 and is pivotally connected thereto at each end by a pivot 151*a*,151*b*. An arm rest support member 97 is fixed to the back of the bracket 150 in any appropriate manner, such as by welding, and extends around to both the left and right sides of the back support assembly 66. Right and left arm rests 98*a*,98*b* are pivotally attached to the ends of the support member 97 by pivots 152*a*,152*b* so that the arm rests 98*a,b* can be pivoted upward out of the way to permit the user to enter and exit the wheelchair through the sides thereof. As shown in FIGS. 1 and 13, the arm rests are parallel to the ground at the seated position and are prevented from pivoting downward past the parallel position by engaging with the support member 97.

As explained above, the back support assembly 66 pivots about the shaft 89 as the seat portion 33 is moved between the seated and standing positions. In particular, as the seat assembly pivots to the standing position, the back support assembly pivots backward, or counterclockwise, when viewing FIG. 1. Since the arm rests 98*a,b* cannot pivot further downward relative to the support member 97, the arm rests would be angled downward when the back support assembly 66 pivots in a backward direction to its vertical orientation. Such a downwardly angled orientation of the arms 98*a,b*, however, would not be comfortable to the user of the wheelchair since the user's arms would also be angled downwardly. Therefore, a mechanism is provided to maintain the arm rests parallel relative to the ground as the seat portion 33 is pivoted to the standing position, as is shown in FIG. 4.

The arm rest leveling mechanism comprises a cable 153 that is secured at each of its ends to the front end of the connector 65 by bolts 154 extending into the connector. The cable 153 extends over the cylindrical portion 76 of the connector 65 (FIG. 13*a*), and then passes underneath the support column 82 to the backside thereof, where the cable is then guided by a roller 155 that is rotatably mounted on a shaft 156 on the central portion 81 of the bracket 80 (FIGS. 13 and 13*b*). The central portion of the cable 153 extends inside the U-shaped bracket 150 where it is looped around, and fixed to, bolts 157 that are secured to the U-shaped bracket 150. When the back support assembly 66 rotates about the pivot 89 as the seat portion is moving to the standing position, the cable 153 will wrap around the cylindrical portion 76, thus taking up the cable 153 and providing a pulling force to the central portion of the cable. The pulling force pulls the U-shaped bracket 150 downward, thus causing the bracket 150, and the support member 97 and arm rests 98*a,b* connected thereto, to pivot about the pivots 151*a,b,* thereby maintaining the arm rests parallel to the ground.

A back support plate 99 is fixed to the front side of the slide 95, and includes a series of vertically spaced holes 100 therein, as seen in FIGS. 13*a* and 13*b*. The plate 99 is secured to the front side of the slide 95 by fasteners 160, such as screws or bolts, that extend through a set of the holes 100 and into threaded holes provided in the front side of the slide 95. The plate 99 can thus be raised or lowered, relative to the slide, to the desired position in order to accommodate different users, and then secured in place. Therefore, the back support assembly is fully adjustable to accommodate different torso lengths. It should be realized that a cushion or pad will normally be disposed over the plate 99 to provide cushioning to the user during use of the wheelchair.

Turning now to FIGS. 1–3 and 11–12, a knee support assembly 105 of the wheelchair is illustrated. As shown, the knee support assembly is located to the rear of the axles 21*a,b*, such that when the user is in the standing position, the users feet are maintained on the foot support portion 28 of the plate 27, behind the axles, so that the weight of the user is located to the rear of the axles, thus enhancing the stability of the wheelchair.

Figure 11:
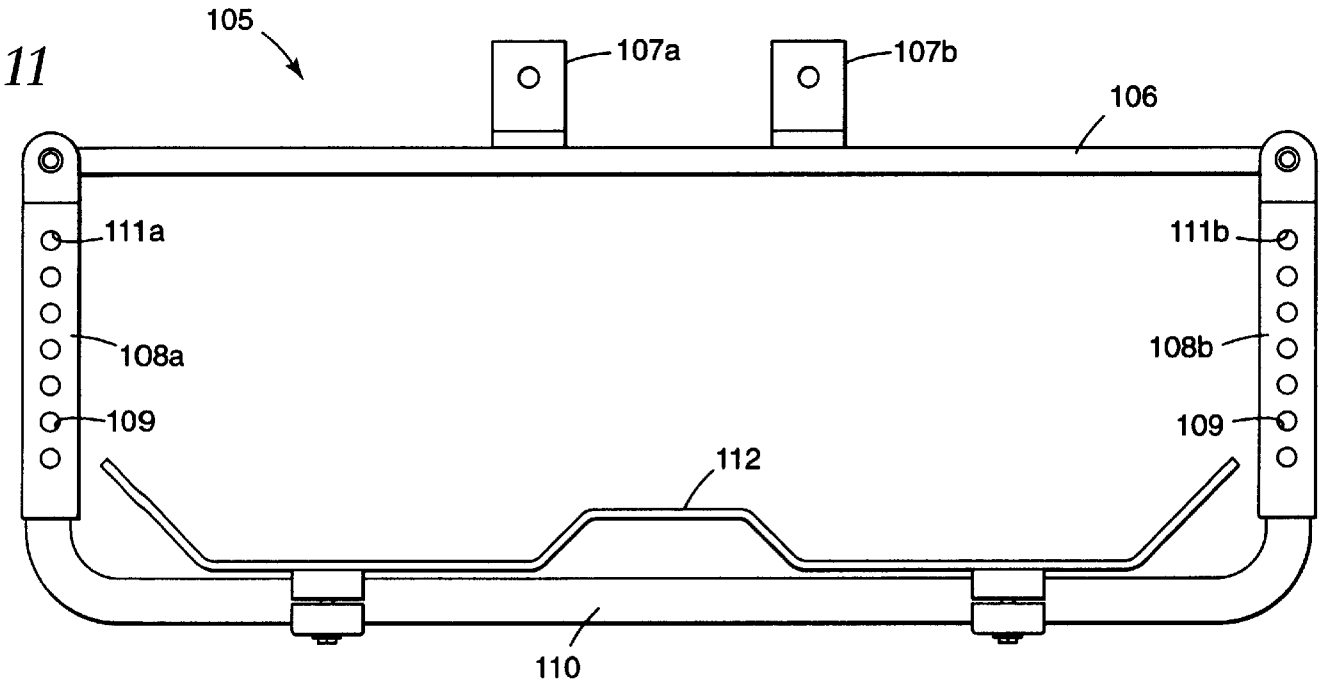
FIG. 11 is a top view of the knee support assembly.
Figure 12:
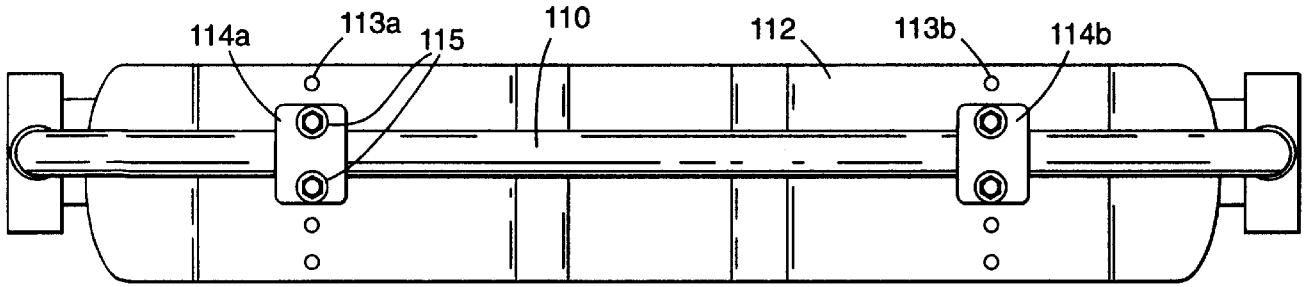
FIG. 12 is a front view of the knee support assembly of FIG. 11.

As shown in FIGS. 11 and 12, the knee support assembly 105 includes a rear knee bar 106 having a pair of flanges 107*a*,107*b* connected thereto. The knee support assembly 105 is attached to the pivot assembly 34 by aligning holes in the flanges 107*a,b* with the threaded holes 47*b,c* in the skirt portion 40 and using fasteners 148 (seen in FIG. 3), such as bolts or screws, to secure the flanges to the skirt portion. Further, the knee bar 106 preferably includes a suitably located hole that aligns with the threaded hole 47*a* in the pivot column 38, and a fastener, such as a screw or bolt, extends through the hole in the bar 106 and into the hole 47*a*. In this manner, the knee support assembly is firmly attached to the pivot assembly 34.

Right and left adjustment bars 108*a*,108*b* extend from the ends of the rear knee bar 106, with each bar 108*a,b* having a plurality of holes 109 therein, with the holes in one bar 108*a* being aligned with the holes in the other bar 108*b*. A front knee bar 110 has right and left ends thereof disposed within the right and left bars 108*a,b*, respectively, for adjustable positioning of the front knee bar. The right and left ends of the front knee bar 110 each have spring loaded detent buttons 111*a*, 111*b* of a type generally known in the art connected thereto, which extend through a pair of aligned holes 109 to lock the bar 110 in place. In order to adjust the bar 110, the detent buttons are pushed downward to permit the ends of the bar 110 to be slid out of, or into, the bars 108*a,b* and engage in a new set of aligned holes 109. In this manner, the knee support assembly is axially adjustable to accommodate different users. Instead of detent buttons, the right and left ends of the bar 110 could each be provided with a hole, which would then be aligned with the holes 109 in the desired position of the knee bar 110, and locking pins then inserted into the holes to secure the bar 110 in place.

A cushion plate 112 is secured to the bar 110 and includes right and left series of vertically spaced holes 113*a*,113*b* to permit vertical adjustment of the plate 112 relative to the bar 110. A cushion or pad will normally be disposed on the plate 112 to cushion a users legs during use of the wheelchair. As shown in FIGS. 11–12, right and left lock members 114*a*, 114*b*, in the form of clamps, are used to secure the plate 112 to the bar 110. A pair of nut and bolt fasteners 115 extend through a pair of each of the series of holes 113*a,b* and into the lock members 114*a,b* to secure the plate in place. In order to adjust the plate 112, the fasteners 115 are removed to permit the plate to be moved upward or downward to the desired position. Further, the fasteners 115 can be loosened to permit the clamps 114*a,b* to be rotated about the bar 110, or slid along the bar, to thereby angularly, and horizontally adjust the position of the plate 112. Once the plate is positioned properly, the fasteners 115 are reinserted and tightened to lock the plate in place.

The knee support assembly 105 is thus able to accommodate different users by being adjustable in four directions relative to the base frame: the first adjustment direction is an axial or horizontal adjustment of the front knee bar 110; the second adjustment direction is a vertical adjustment of the plate 112; the third adjustment direction is an angular adjustment of the plate 112 about the bar 110; and the fourth adjustment direction is a side-to-side horizontal adjustment of the plate 112 along the bar 110.

In the wheelchair as described above, the user, as well as the center of mass of the user and the seat assembly, are positioned behind the axles of the front wheels when in the seated and standing position, thereby enhancing the stability of the wheelchair. The weight of the user and the seat assembly are maintained within the boundaries of the wheels of the wheelchair, and no moment force is created about the axles of the front wheels in a direction tending to tip the wheelchair in a forward direction. Therefore, the stability of the wheelchair in the standing position is enhanced. Further, since the user is located behind the axles, the weight of the wheelchair can be more evenly and advantageously distributed, such as by permitting the heavy batteries to be located more centrally on the frame, such as underneath the frame between the front and rear wheels, instead of at the rear of the frame. By evenly distributing the weight, the stability of the wheelchair is further enhanced.

Further, by utilizing a stub pivot shaft 58 to connect the front center of the seat portion to the pivot assembly 34, and using the pivot column to offset the pivot shaft above the seat portion 33, the shear on the user that is created while the seat portion is moving between its seated and standing positions is reduced, because the stub pivot shaft is located between the user's knees, closer to the user's knee joints. The single, centrally located stub pivot shaft further reduces the number of parts of the wheelchair and thus simplifies the structure of the wheelchair and makes it more visually appealing.

The wheelchair of the present invention also provides a proper standing posture for the user by placing the seat portion at approximately a 10 degree angle from vertical when in the standing position, which the inventor has discovered increases user comfort. Such a position further improves the reach capability of the user, compared with previous standing wheelchairs that position a user at up to a 27 degree angle from vertical, thus permitting the user to lead a more productive and independent life.

The wheelchair is also fully adjustable to accommodate different users, and has fewer moving parts compared to conventional standing wheelchairs thus reducing breakdowns, maintenance and repairs. Further, since the wheelchair is of simple design and uses a reduced number of parts, the cost of the wheelchair is reduced compared with conventional models.

In addition to the above benefits, the wheelchair of the present invention has improved visual appeal. This can be seen with regard to FIG. 4, where the actuator is substantially hidden within the channel of the seat support bar when in the standing position, and the linkage 90 is hidden behind the seat support bar. Further, no linkages extend directly between the seat portion and the base frame that might make the wheelchair appear to be mechanically complex and detract from the visual appeal of the wheelchair. Thus there are fewer mechanical parts that are visible, so that people view the individual in the wheelchair and not the mechanical parts of the wheelchair. The simple, compact construction of the present invention also facilitates the use of shaped body panels to cover certain areas of the wheelchair so as to further add to the visual appeal of the wheelchair.

It is to be understood that while certain embodiments of the present invention have been illustrated and described, the invention is not limited to the specific forms or arrangements of the parts described and shown.

What is claimed is:

1. A standing wheelchair, comprising:

a base frame having front and rear ends;

a pair of front wheels connected to the front end of the base frame for supporting the front of the wheelchair and at least one rear wheel connected to the rear end of the base frame for supporting the rear of the wheelchair; and a seat assembly connected to the front end of the base frame, said seat assembly including a seat portion having a front center, said seat portion pivotable between a generally horizontal, seated position and an angled standing position, and an actuator for actuating the seat portion between the seated and standing positions; the seat assembly further including a stub pivot shaft located proximate the front center of the seat portion for pivotally connecting the seat portion to the base frame, said stub pivot shaft being spaced vertically above the seat portion.

2. The standing wheelchair according to claim 1, wherein the seat assembly further includes a seat pivot connected to the seat portion adjacent the front center thereof, said seat pivot having a first end extending vertically above the seat portion; said seat assembly further including a pivot assembly connected to the front end of the base frame at the center thereof, said pivot assembly including a vertically extending pivot column having a first end extending vertically above the seat portion adjacent to the first end of the seat pivot, the first end of the seat pivot being pivotally connected to the first end of the pivot column by said stub pivot shaft.

3. The standing wheelchair according to claim 2, wherein the actuator is connected at one end thereof to the pivot assembly and connected at an opposite end thereof to a rear end of the seat portion proximate the center thereof.

4. The standing wheelchair according to claim 3, wherein the pivot assembly is detachably connected to the base frame, whereby the seat assembly is removable as a single unit from said base frame.

5. The standing wheelchair according to claim 4, wherein the pivot assembly is the only connection between the base frame and the seat assembly.

6. The standing wheelchair according to claim 1, further including a knee support assembly connected to the seat assembly and extending forwardly therefrom.

7. The standing wheelchair according to claim 6, wherein said knee support assembly is adjustable in at least four directions relative to the base frame.

8. The standing wheelchair according to claim 7, wherein said knee support assembly is horizontally, vertically and angularly adjustable relative to the base frame.

9. The standing wheelchair according to claim 3, wherein the seat portion includes a seat support bar extending between the front and rear ends thereof proximate the center thereof, said seat support bar defining a channel facing the actuator, and wherein the opposite end of the actuator is disposed within the channel.

10. The standing wheelchair according to claim 9, wherein said actuator is substantially disposed within said channel when the seat portion is pivoted to the standing position.

11. The standing wheelchair according to claim 2, further including a back support assembly pivotally connected to the seat portion, said back support assembly being oriented at an angled position relative to a ground surface at the seated position and oriented at a vertical position relative to a ground surface at the standing position.

12. The standing wheelchair according to claim 11, wherein the back support assembly is adjustable relative to the seat portion.

13. The standing wheelchair according to claim 11, further including a linkage connected between the pivot assembly and the back support assembly.

14. The standing wheelchair according to claim 11, wherein the back support assembly includes a back support plate, the position of said back support plate on said back support assembly being adjustable.

15. The standing wheelchair according to claim 11, wherein the back support assembly includes first and second arm rests pivotally connected thereto and being disposed parallel to the ground when the seat portion is in the seated position, and further including a leveling mechanism connected to the first and second arm rests to maintain the arm rests parallel to the ground when the seat portion is moved to the standing position.

16. The standing wheelchair according to claim 15, wherein the back support assembly includes a connector disposed adjacent a base thereof for connecting the back support assembly to the seat portion; and wherein the leveling mechanism comprises a bracket that is pivotally mounted on the back support assembly and is connected to the arm rests, and a cable connected to the bracket and to the connector.

17. The standing wheelchair according to claim 1, wherein said seat portion is positioned at approximately 10 degrees from vertical when in the standing position.

18. The standing wheelchair according to claim 1, further comprising electric motors drivingly engaged with said front wheels for rotating said front wheels.

19. The standing wheelchair according to claim 18, further comprising batteries for supplying power to said electric motors, said batteries being disposed underneath the base frame between the front wheels and the at least one rear wheel.

20. The standing wheelchair according to claim 19, further including brackets connected to, and extending underneath, the base frame, the batteries being supported by said brackets.

21. The standing wheelchair according to claim 20, further comprising a suspension system connected between each of the front wheels and the base frame.

22. The standing wheelchair according to claim 21, wherein each said suspension system includes an arm connected at one end thereof to the respective electric motor and pivotally connected at an opposite end thereof to one of said brackets, and a shock absorber assembly connected to the arm intermediate the ends thereof and connected to the base frame.

23. The standing wheelchair according to claim 22, wherein each said shock absorber assembly includes a suspension bracket fixed at one end thereof to the respective arm, and a shock absorber having a first end fixed to a second end of the suspension bracket and a second end fixed to said base frame.

24. The standing wheelchair according to claim 23, wherein the second end of the suspension bracket is U-shaped, and further including at least one drain hole formed in said U-shaped second end.

25. The standing wheelchair according to claim 1, further including a footrest plate connected to the front end of the base frame and extending forwardly therefrom between the front wheels, and said footrest plate extends to a position forward of the front wheels.

26. The standing wheelchair according to claim 1, wherein the actuator is an electric actuator.

27. A standing wheelchair, comprising:

a base frame having front and rear ends;

a pair of front wheels connected to the front end of the base frame for supporting the front of the wheelchair and at least one rear wheel connected to the rear end of the base frame for supporting the rear of the wheelchair; and a seat assembly connected to the front end of the base frame, said seat assembly including a seat portion pivotable between a generally horizontal, seated position and an angled standing position, and an actuator for actuating the seat portion between the seated and standing positions; said actuator being connected at a first end thereof to a front end of the seat assembly and connected at a second end thereof to a rear end of the seat portion proximate the center thereof; wherein the front end of the seat portion is pivotally connected to the base frame by a pivot assembly which is the only connection between the seat assembly and the base frame; and wherein the seat portion includes a seat support bar extending between the front and rear ends thereof proximate the center thereof, said seat support bar defining a channel facing the actuator, and wherein the second end of the actuator is disposed within the channel, and wherein the first end of the actuator is disposed outside of the channel.

28. The standing wheelchair according to claim 27, wherein said actuator is inline with said channel when the seat portion is pivoted to the standing position.

29. A standing wheelchair, comprising:

a base frame having front and rear ends;

a pair of front wheels connected to the front end of the base frame for supporting the front of the wheelchair and at least one rear wheel connected to the rear end of the base frame for supporting the rear of the wheelchair; and a seat assembly connected to the front end of the base frame, said seat assembly including a seat portion pivotable between a generally horizontal, seated position and an angled standing position, and an actuator for actuating the seat portion between the seated and standing positions;

a back support assembly pivotally connected to the seat portion, and first and second arm rests pivotally connected to the back support assembly; and a leveling mechanism connected to the first and second arm rests to maintain the arm rests parallel to a ground surface when the seat portion is moved to the standing position, wherein the back support assembly includes a connector disposed adjacent a base thereof for connecting the back support assembly to the seat portion; and wherein the leveling mechanism comprises a bracket that is pivotally mounted on the back support assembly and is connected to the arm rests, and a cable connected to the bracket and to the connector.

* * * * *